US009343022B2

(12) United States Patent
Park et al.

(10) Patent No.: US 9,343,022 B2
(45) Date of Patent: May 17, 2016

(54) DISPLAY PANEL HAVING A MAIN COLOR SUBPIXEL AND A MULTI-PRIMARY SUBPIXEL AND DISPLAY APPARATUS HAVING THE SAME WITH REDUCED NUMBER OF DATA LINES

(75) Inventors: Tae-Hyeong Park, Yongin-si (KR); Dong-Ho Lee, Yongin-si (KR); Joon-Ha Park, Suwon-si (KR); Sang-Cheol Shin, Yongin-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 613 days.

(21) Appl. No.: 13/167,155

(22) Filed: Jun. 23, 2011

(65) Prior Publication Data

US 2012/0098871 A1 Apr. 26, 2012

(30) Foreign Application Priority Data

Oct. 21, 2010 (KR) ..... 10-2010-0102804

(51) Int. Cl.
*G09G 3/36* (2006.01)

(52) U.S. Cl.
CPC ..... *G09G 3/3607* (2013.01); *G09G 3/3614* (2013.01); *G09G 3/3688* (2013.01); *G09G 2300/0426* (2013.01); *G09G 2300/0452* (2013.01); *G09G 2310/027* (2013.01); *G09G 2310/0281* (2013.01); *G09G 2310/0297* (2013.01); *G09G 2320/0242* (2013.01); *G09G 2320/0247* (2013.01); *G09G 2320/0276* (2013.01); *G09G 2340/06* (2013.01)

(58) Field of Classification Search
CPC .. G09G 3/2074; G09G 3/3607; G09G 3/3614
See application file for complete search history.

(56) References Cited

U.S. PATENT DOCUMENTS

| | | | | |
|---|---|---|---|---|
| 6,552,706 | B1 * | 4/2003 | Ikeda et al. | 345/96 |
| 6,888,604 | B2 * | 5/2005 | Rho | G02F 1/133514 349/144 |
| 6,954,191 | B1 * | 10/2005 | Hirano et al. | 345/77 |
| 8,605,126 | B2 * | 12/2013 | Kang | G09G 3/3614 345/55 |
| 2003/0146893 | A1 * | 8/2003 | Sawabe | 345/89 |
| 2003/0197826 | A1 * | 10/2003 | Yun et al. | 349/149 |
| 2004/0234163 | A1 * | 11/2004 | Lee et al. | 382/298 |
| 2006/0081850 | A1 * | 4/2006 | Lee et al. | 257/72 |
| 2006/0120160 | A1 * | 6/2006 | Park et al. | 365/185.22 |
| 2006/0202927 | A1 * | 9/2006 | Lee | 345/88 |
| 2007/0064190 | A1 * | 3/2007 | Kim | 349/142 |
| 2007/0091043 | A1 * | 4/2007 | Rho et al. | 345/88 |
| 2008/0062112 | A1 * | 3/2008 | Umezaki | 345/100 |
| 2008/0079755 | A1 * | 4/2008 | Shiomi | 345/690 |

(Continued)

*Primary Examiner* — Claire X Pappas
*Assistant Examiner* — Robert Stone
(74) *Attorney, Agent, or Firm* — Cantor Colburn LLP

(57) ABSTRACT

A display panel includes a plurality of pixels including at least four even-numbered subpixels. The at least four even-numbered subpixels includes: a first red subpixel including a pixel electrode electrically connected to a switching element which is connected to a first data line and a first gate line; a first green subpixel including a pixel electrode electrically connected to a switching element which is connected to a second data line and a second gate line, where the second data line is disposed adjacent to the first data line; a first blue subpixel including a pixel electrode electrically connected to a switching element which is connected to the first data line and the second gate line; and a first multi-primary subpixel including a pixel electrode electrically connected to a switching element which is connected to the second data line and the first gate line.

17 Claims, 9 Drawing Sheets

(56) References Cited

U.S. PATENT DOCUMENTS

2008/0252558 A1* 10/2008 Kim ..... G09G 3/2003 345/55
2008/0266225 A1* 10/2008 Kim ..... 345/88
2009/0040243 A1* 2/2009 Hisada et al. ..... 345/690
2009/0051638 A1* 2/2009 Horiuchi et al. ..... 345/88
2009/0195495 A1* 8/2009 Hsu et al. ..... 345/104
2009/0225015 A1* 9/2009 Itoh et al. ..... 345/84
2009/0225103 A1* 9/2009 Shiomi ..... 345/690
2010/0103339 A1* 4/2010 Shimoshikiryoh et al. ..... 349/39
2010/0110114 A1* 5/2010 Hashimoto ..... 345/691
2010/0141693 A1* 6/2010 Lee ..... G09G 3/3216 345/694
2010/0156954 A1* 6/2010 Kim et al. ..... 345/690
2010/0289733 A1* 11/2010 Kim et al. ..... 345/92
2010/0302215 A1* 12/2010 Tsai ..... G09G 3/3614 345/204
2011/0242065 A1* 10/2011 Hsu et al. ..... 345/204
2012/0206437 A1* 8/2012 Kang et al. ..... 345/213
2014/0049619 A1* 2/2014 Hsieh ..... H04N 13/0413 348/51

* cited by examiner

DISPLAY PANEL HAVING A MAIN COLOR SUBPIXEL AND A MULTI-PRIMARY SUBPIXEL AND DISPLAY APPARATUS HAVING THE SAME WITH REDUCED NUMBER OF DATA LINES

This application claims priority to Korean Patent Application No. 2010-102804, filed on Oct. 21, 2010, and all benefits accruing therefrom under 35 U.S.C. §119, the content of which in its entirety is herein incorporated by reference.

BACKGROUND OF THE INVENTION (1) Field of the Invention

The general inventive concepts relate to a display panel and a display apparatus having the display panel. More particularly, the general inventive concepts relate to a display panel having a multi-primary subpixel and a display apparatus having the display panel.

(2) Description of the Related Art

Generally, a liquid crystal display ("LCD") apparatus includes an LCD panel, and data and gate drivers. The LCD panel includes an array substrate, a color filter substrate and a liquid crystal layer. The array substrate includes a plurality of data lines, a plurality of gate lines, a plurality of switching elements and a plurality of pixel electrodes. The color filter substrate includes a plurality of color filters and a common electrode facing the pixel electrodes. The liquid crystal layer is disposed between the array substrate and the color filter substrate, and the longitudinal axes of liquid crystals in the liquid crystal layer are arranged by an electric field generated between the pixel electrode and the common electrodes.

The LCD panel includes a RGB pixel structure including red, green and blue subpixels. Recently, a RGBW pixel structure has been developed to improve color reproduction and luminance of the LCD panel. The RGBW pixel structure includes red, green, blue and white subpixels. Accordingly, when a white subpixel may be added to the conventional RGB pixel structure to enhance luminance characteristics and to increase a range of the color reproduction.

BRIEF SUMMARY OF THE INVENTION

Exemplary embodiments of the present invention provide a display panel including a multi-primary subpixel with improved display quality and reduced number of lines.

Exemplary embodiments of the present invention also provide a display apparatus having the display panel.

In an exemplary embodiment, a display panel includes a plurality of pixels including at least four even-numbered subpixels. The at least four even-numbered subpixels includes: a first red subpixel including a pixel electrode electrically connected to a switching element which is connected to a first data line and a first gate line; a first green subpixel including a pixel electrode electrically connected to a switching element which is connected to a second data line and a second gate line, where the second data line is disposed adjacent to the first data line; a first blue subpixel including a pixel electrode electrically connected to a switching element which is connected to the first data line and the second gate line; and a first multi-primary subpixel including a pixel electrode electrically connected to a switching element which is connected to the second data line and the first gate line.

In an alternative exemplary embodiment, the display panel includes: a plurality of pixels including at least four even-numbered subpixels; a first gate driver connected to a first gate line and disposed in a peripheral area adjacent to a first side of a display area, in which the pixels are disposed; and a second gate driver connected to a second gate line and disposed in a peripheral area adjacent to a second side of the display area, where the second side is opposite to the first side. The at least four even-numbered subpixels includes: a first red subpixel including a pixel electrode electrically connected to a switching element which is connected to a first data line extending along a first direction and the first gate line extending along a second direction; a first green subpixel including a pixel electrode electrically connected to a switching element which is connected to a second data line and the first gate line, where the second data line is disposed adjacent to the first data line; a first blue subpixel including a pixel electrode electrically connected to a switching element which is connected to the first data line and the second gate line; and a first multi-primary subpixel including a pixel electrode electrically connected to a switching element which is connected to the second data line and the second gate line.

In another alternative exemplary embodiment, the display panel includes a display panel and a panel driver which drivers the display panel. The display panel includes: a plurality of pixels including at least four even-numbered subpixels; a first gate driver connected to a first gate line and disposed adjacent to a first side of a display area, in which the pixels are disposed; and a second gate driver connected to a second gate line and disposed adjacent to a second side of the display area, where the second side is different from the first side. The at least four even-numbered subpixels includes: a first red subpixel including a pixel electrode electrically connected to a switching element which is connected to a first data line extending along a first direction and the first gate line extending along a second direction; a first green subpixel including a pixel electrode electrically connected to a switching element which is connected to a second data line and the second gate line, the second data line being adjacent to the first data line; a first blue subpixel including a pixel electrode electrically connected to a switching element which is connected to the first data line and the second gate line; and a first multi-primary subpixel including a pixel electrode electrically connected to a switching element which is connected to the second data line and the first gate line. The panel driver applies a first polarity voltage to each of the first red subpixel and the first blue subpixel, and applies a second polarity voltage to each of the first green subpixel and the first multi-primary subpixel. The second polarity voltage is reversed from the first polarity voltage with respect to a reference voltage In still another alternative exemplary embodiment, the display panel includes a display panel and a panel driver which drives the display panel. The display panel includes: a plurality of pixels including at least four even-numbered subpixels; and a first gate driver connected to a first gate line and disposed adjacent to a first side of a display area in which the plurality of pixels are disposed; and a second gate driver connected to a second gate line and disposed adjacent to a second side of the display area, where the second side is different from the first side of a display. The at least four even-numbered subpixels includes: a first red subpixel including a pixel electrode electrically connected to a switching element which is connected to a first data line extending along a first direction and the first gate line extending along a second direction; a first green subpixel including a pixel electrode electrically connected to a switching element which is connected to a second data line and the first gate line, the second data line being adjacent to the first data line; a first blue subpixel including a pixel electrode electrically connected to a switching element connected to the first data line and the second gate line; and a first multi-primary subpixel including a pixel electrode electrically connected to a switching element connected to the second data line and the second gate line. The a panel driver applies a first polarity voltage to each of the first red subpixel and the first blue subpixel, and applies a second polarity voltage to each of the first green subpixel and the first multi-primary subpixel. The second polarity voltage is reversed from the first polarity voltage with respect to a reference voltage.

In exemplary embodiments, a gate driver is directly disposed on a display panel such that a data line may be shared by two colors of subpixels and thus the number of the data line may be substantially reduced without incurring additional manufacturing costs due to increased number of gate lines. In addition, an image is displayed using a multi-primary subpixel, such that a range of color reproduction may be substantially extended, and data voltages having different polarities are applied to adjacent subpixels of a same color, such that display quality may be substantially improved.

BRIEF DESCRIPTION OF THE DRAWINGS

The above and other features and advantages of the present invention will become more apparent by describing in detailed exemplary embodiments thereof with reference to the accompanying drawings, in which.

DETAILED DESCRIPTION OF THE INVENTION

Figure 1:
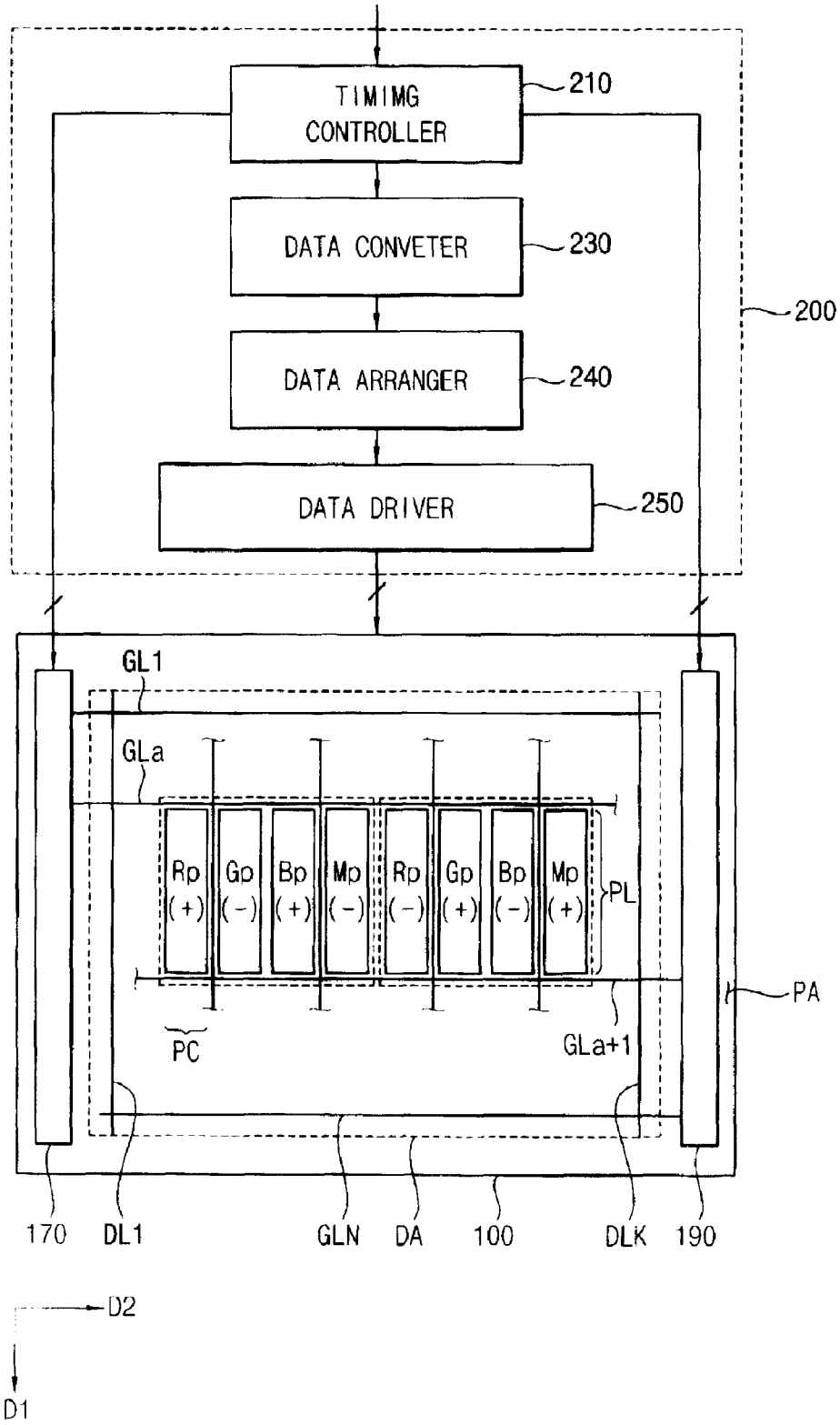
FIG. 1 is a block diagram illustrating an exemplary embodiment of a display apparatus according to the present invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of the present invention will be explained in detail with reference to the accompanying drawings.

FIG. 1 is a block diagram illustrating an exemplary embodiment of a display apparatus according to the present invention.

Referring to FIG. 1, an exemplary embodiment of the display apparatus includes a display panel 100 and a panel driver 200.

The display panel 100 includes a display area DA and a peripheral area PA surrounding the display area DA. A plurality of pixels P, a plurality of data lines DL1 to DLK extending along a first direction D1 and a plurality of gate lines GL1 to GLN extending along a second direction D2 and crossing the first direction D1 are disposed in the display area DA of the display panel 100. The pixels P include a main color subpixel and a multi-primary subpixel, and include a plurality of subpixel rows PL and a plurality of subpixel columns PC. In an exemplary embodiment the main color subpixel includes a red subpixel Rp, a green subpixel Gp and a blue subpixel Bp, but not being limited thereto. In an alternative exemplary embodiment, the multi-primary subpixel Mp may includes white, yellow, cyan, magenta subpixels. When the pixels P include the multi-primary subpixel, luminance of the display panel is substantially enhanced and a range of color reproduction increases based on a color of the multi-primary subpixel. Although not shown in the figure, the subpixels includes a pixel switching element connected to the data lines DL1 to DLK and the gate lines GL1 to GLN, and a pixel electrode connected to the pixel switching element. In an exemplary embodiment, the pixel switching element may be a thin film transistor ("TFT") including amorphous silicon. Each of the data lines DL1 to DLK are electrically connected to the pixels in two subpixel columns PC adjacent to each other. Thus, the number of the data lines DL1 to DLK may be decreased by a half compared to the number of the subpixel columns PC. Here, 'K' is a natural number.

The gate lines GL1 to GLN include a pair of gate lines, e.g., a first gate line GLa and a second gate line GLa+1, electrically connected to the pixels in a single subpixel rows PC. Here, 'a' and 'N' are natural numbers.

A first gate driver 170 and a second gate driver 190 are disposed in the peripheral area PA of the display panel 100.

The first gate driver 170 is disposed in the peripheral area PA and adjacent to a first side of the display area DA. The first gate driver 170 provides a gate signal to an odd-numbered gate line GLa of the pair of gate lines GLa and GLa+1.

The second gate driver 190 is disposed in the peripheral area PA and adjacent to a second side of the display area DA which is different from the first side of the display area DA. The second gate driver 190 provides a gate signal to an even-numbered gate line GLa+1 of the pair of gate lines GLa and GLa+1.

A delay occurs between the gate signal applied to the odd-numbered gate line GLa and the gate signal applied to the even-numbered gate line GLa+1 by the first and second gate drivers 170 and 190.

Each of the first and second gate drivers 170 and 190 may include a circuit switching element disposed on the display panel 100. In an exemplary embodiment, the circuit switching element may be formed on the display panel 100 by a process substantially same as a process for forming the pixel switching element in the subpixel. In an exemplary embodiment, the circuit switching element may be the TFT including the amorphous silicon.

As shown in FIG. 1, the gate lines GL1 to GLN, which is connected to the first and second gate drivers 170 and 190, are alternately arranged with each other. However, the arrangement of gate lines GL1 to GLN of exemplary embodiments is not limited thereto. In an exemplary embodiment, the first and second gate drivers 170 and 190 may be disposed in the peripheral area PA and adjacent to a same side of the display area DA. In an alternative exemplary embodiment, the first gate driver 170 is connected to first ends of all of the gate lines GL1 to GLN, and the second gate driver 190 is connected to second ends of all of the gate lines GL1 to GLN, where the second ends face the first ends.

The panel driver 200 includes a timing controller 210, a data converter 230, a data arranger 240 and a data driver 250.

The timing controller 210 controls a driving timing of the data driver 250 and the first and second gate drivers 170 and 190 based on a synchronized signal received from an external device.

The data converter 230 generates red, green, blue and multi-primary data using red, green and blue data received from the external device. The multi-primary data include color data corresponding to the multi-primary subpixel in the display panel 100.

The data arranger 240 rearranges the red, green, blue and multi-primary data received from the data converter 230 based on a pixel structure of the display panel 100.

The data driver 250 converts the red, green, blue and multi-primary data received from the data converter 230 to the red, green, blue and multi-primary data voltages using a gamma voltage. In addition, the data driver 250 generates the data voltages having a first polarity (for example, a positive polarity) or a second polarity (for example, a negative polarity) with respect to a reference voltage (for example, a common voltage) and outputs the data voltages. The data driver 250 drives the display panel 100 using a dot inversion method or a column inversion method. In the dot inversion method, the voltages are applied to the pixels in an order of positive (+), negative (−), negative (−) and positive (+) voltages. In the column inversion method, the voltages reversed by a horizontal period unit 1H are applied to the pixels.

Figure 2:
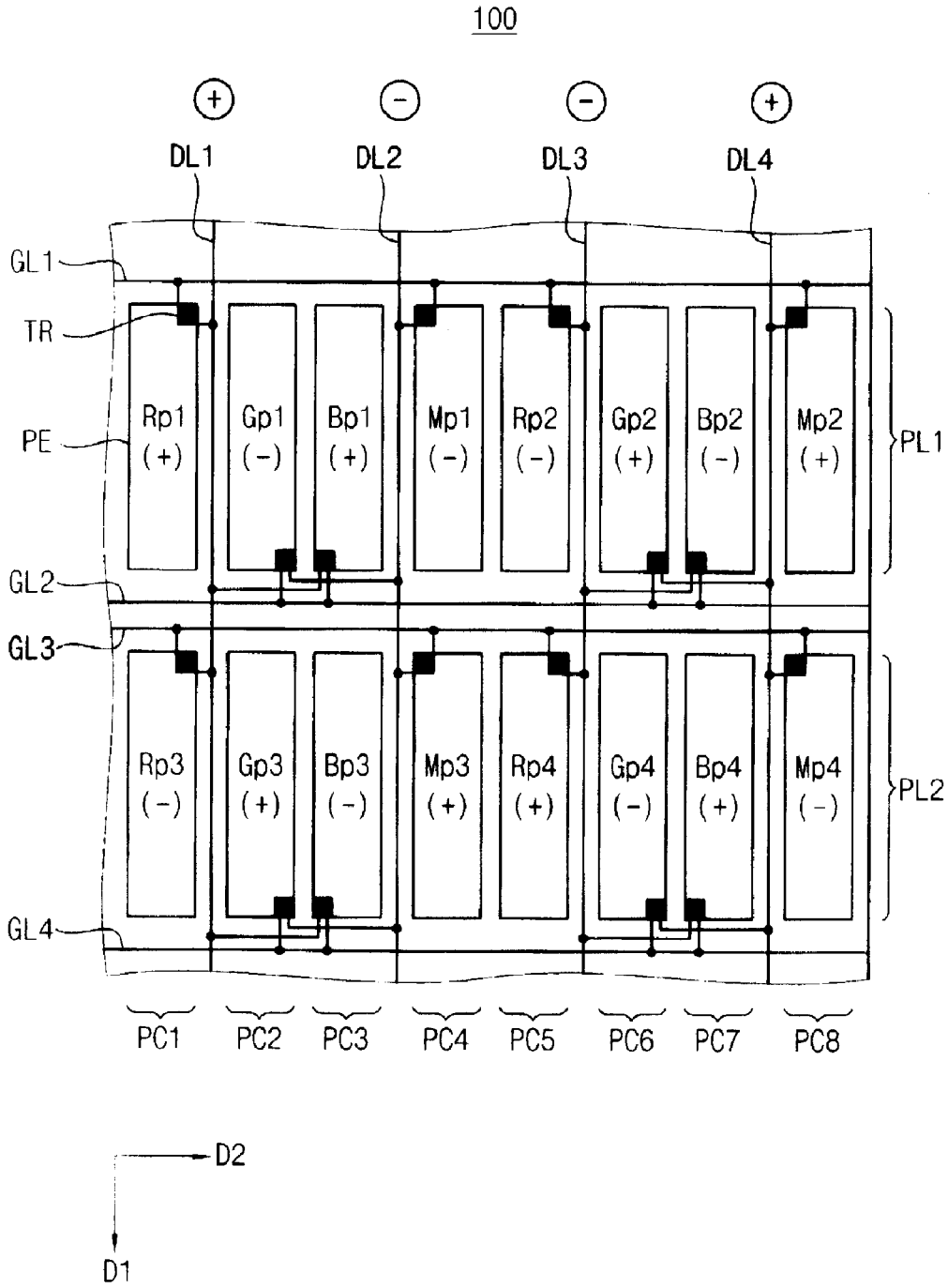
FIG. 2 is a top plan view of an exemplary embodiment of a display panel in FIG. 1.

FIG. 2 is a top plan view of an exemplary embodiment of the display panel 100 in FIG. 1.

Referring to FIGS. 1 and 2, the display panel 100 includes a plurality of data lines, e.g., a first data line DL1, a second data line DL2, a third data line DL3 and a fourth data line DL4, a plurality of gate lines, e.g., a first gate line GL1, a second gate line GL2, a third gate line GL3, a fourth gate line GL4, a fifth gate line GL5 and a sixth gate line GL6 and a plurality of color subpixels, e.g., a first red subpixel Rp1, a first green subpixel Gp1, a first blue subpixel Bp1, a first multi-primary subpixel Mp1, a second red subpixel Rp2, a second green subpixel Gp2, a second blue subpixel Bp2, a second multi-primary subpixel Mp2, a third red subpixel Rp3, a third green subpixel Gp3, a third blue subpixel Bp3, a third multi-primary subpixel Mp3, a fourth red subpixel Rp4, a fourth green subpixel Gp4, a fourth blue subpixel Bp4 and a fourth multi-primary subpixel Mp4. The color subpixels are arranged in a matrix form having a plurality of subpixel rows, e.g., a first subpixel row PL1 and a second subpixel row PL2, and a plurality of subpixel columns, e.g., a first subpixel column PC1, a second subpixel column PC2, a third subpixel column PC3, . . . , an eighth subpixel column PC8. Each of the color subpixels includes a pixel switching element TR and a pixel electrode PE. The pixel switching element TR is electrically connected to the data lines DL, the gate lines GL and the pixel electrode PE. Hereinafter, the pixel switching element TR is referred to as a switching element.

The first data line DL1 is disposed between the first and second subpixel columns PC1 and PC2. The second data line DL2 is disposed between the third and fourth subpixel columns PC3 and PC4. The third data line DL3 is disposed between the fifth and sixth subpixel columns PC5 and PC6. The fourth data line DL4 is disposed between the seventh and eighth subpixel columns PC7 and PC8. The first and second gate lines GL1 and GL2 are respectively disposed above and below of the first subpixel row PL1. The third and fourth gate lines GL3 and GL4 are disposed above and below the second subpixel row PL2, respectively.

The first red subpixel Rp1, the first green subpixel Gp1, the first blue subpixel Bp1, the first multi-primary subpixel Mp1, the second red subpixel Rp2, the second green subpixel Gp2, the second blue subpixel Bp2 and the second multi-primary subpixel Mp2 are disposed in the first subpixel row PL1.

The first red subpixel Rp1 is connected to the first gate line GL1 and the first data line DL1 through the switching element TR thereof. The first green subpixel Gp1 is connected to the second gate line GL2 and the second data line DL2 through the switching element TR thereof. The first blue subpixel Bp1 is connected to the second gate line GL2 and the first data line DL1 through the switching element TR thereof. The first multi-primary subpixel Mp1 is connected to the first gate line GL1 and the second data line DL2 through the switching element TR thereof.

The second red subpixel Rp2 is connected to the first gate line GL1 and the third data line DL3 through the switching element TR thereof. The second green subpixel Gp2 is connected to the second gate line GL2 and the fourth data line DL4 through the switching element TR thereof. The second blue subpixel Bp2 is connected to the second gate line GL2 and the third data line DL3 through the switching element TR thereof. The second multi-primary subpixel Mp2 is connected to the first gate line GL1 and the fourth data line DL4 through the switching element TR thereof.

The third red subpixel Rp3, the third green subpixel Gp3, the third blue subpixel Bp3, the third multi-primary subpixel Mp3, the fourth red subpixel Rp4, the fourth green subpixel Gp4, the fourth blue subpixel Bp4 and the fourth multi-primary subpixel Mp4 are disposed in the second subpixel row PL2.

The third red subpixel Rp3 is connected to the third gate line GL3 and the first data line DL1 through the switching element TR thereof. The third green subpixel Gp3 is connected to the fourth gate line GL4 and the second data line DL2 through the switching element TR thereof. The third blue subpixel Bp3 is connected to the fourth gate line GL4 and the first data line DL1 through the switching element TR thereof. The third multi-primary subpixel Mp3 is connected to the third gate line GL3 and the second data line DL2 through the switching element TR thereof.

The fourth red subpixel Rp4 is connected to the third gate line GL3 and the third data line DL3 through the switching element TR thereof. The fourth green subpixel Gp4 is connected to the fourth gate line GL4 and the fourth data line DL4 through the switching element TR thereof. The fourth blue subpixel Bp4 is connected to the fourth gate line GL4 and the third data line DL3 through the switching element TR thereof. The fourth multi-primary subpixel Mp4 is connected to the third gate line GL3 and the fourth data line DL4 through the switching element TR thereof.

Figure 3:
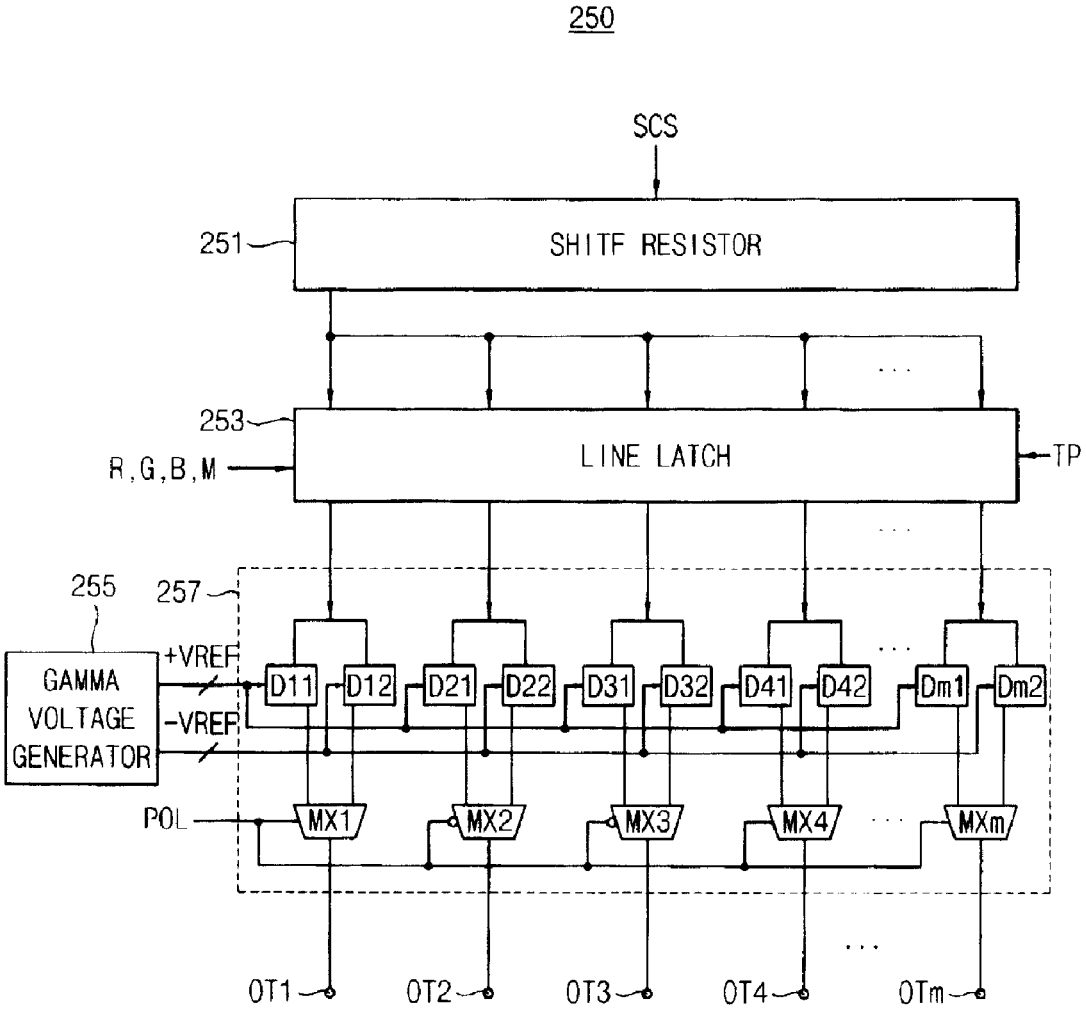
FIG. 3 is a block diagram illustrating an exemplary embodiment of a data driver in FIG. 1.

FIG. 3 is a block diagram illustrating an exemplary embodiment of the data driver 250 in FIG. 1.

Referring back to FIGS. 1 and 2, the panel driver 200 includes the data arranger 240 and the data driver 250.

The data arranger 240 rearranges the red, green, blue and multi-primary data received from the data converter 230 based on a color subpixel structure of the display panel 100. In an exemplary embodiment, the data arranger 240 rearranges color data of the first subpixel row PL1 to color data of the first red subpixel Rp1, the first multi-primary subpixel Mp1, the second red subpixel Rp2 and the second multi-primary subpixel Mp2, and outputs the color data of the first red subpixel Rp1, the first multi-primary subpixel Mp1, the second red subpixel Rp2 and the second multi-primary subpixel Mp2 during a first sub-period of a first horizontal period. In addition, the data arranger 240 rearranges color data of the first subpixel row PL1 to color data of the first green subpixel Gp1, the first blue subpixel Bp1, the second green subpixel Gp2 and the second blue subpixel Bp2, and outputs the color data of the first green subpixel Gp1, the first blue subpixel Bp1, the second green subpixel Gp2 and the second blue subpixel Bp2 during a second sub-period of the first horizontal period. Then, the data arranger 240 rearranges color data of the second subpixel row PL2 to color data of the third red subpixel Rp3, the third multi-primary subpixel Mp3, the fourth red subpixel Rp4 and the fourth multi-primary subpixel Mp4, and outputs the color data of the third red subpixel Rp3, the third multi-primary subpixel Mp3, the fourth red subpixel Rp4 and the fourth multi-primary subpixel Mp4 during a first sub-period of a second horizontal period. In addition, the data arranger 240 rearranges color data of the second subpixel row PL2 to color data of the third green subpixel Gp3, the third blue subpixel Bp3, the fourth green subpixel Gp4 and the fourth blue subpixel Bp4, and outputs the color data of the third green subpixel Gp3, the third blue subpixel Bp3, the fourth green subpixel Gp4 and the fourth blue subpixel Bp4 during a second sub-period of the second horizontal period. In an exemplary embodiment, each of the first and second sub-periods may correspond to a half of a horizontal period ½H.

Referring now to FIG. 3, the date driver 250 includes a shift resistor 251, a lines latch 253, a gamma voltage generator 255 and a digital-analog convertor 257.

The shift resistor 251 shifts a sampling signal in response to a sampling clock signal SCS provided from the timing controller 210.

The line latch 253 samples red, green, blue and multi-primary data R, G, B and M, which are digital data inputted thereto, in response to the sampling signal, and latches the red, green, blue and multi-primary data R, G, B and M by a horizontal line unit.

The gamma voltage generator 255 generates a first polarity gamma voltage +VREF and a second polarity gamma voltage −VREF. In an exemplary embodiment, the first polarity gamma voltage +VREF may be a high potential voltage with respect to the common voltage, and the second polarity gamma voltage −VREF may be a low potential voltage with respect to the common voltage.

The digital-analog convertor 257 includes a first decoding part, a second decoding part and a multiplexing part. The first decoding part includes a plurality of first decoders D11, D21, D31, . . . , Dm1. Each of the first decoders D11, D21, 31, . . . , Dm1 subdivides the color data into a number of grayscales, which corresponds to a number of bits of the color data, using the first polarity gamma voltages, and outputs a first polarity data voltage corresponding to the grayscale of the input color data. The second decoding part includes a plurality of second decoders D12, D22, D32, . . . , Dm2. Each of the second decoders D12, D22, D32, . . . , Dm2 subdivides the color data into a number of the grayscales, which corresponds to a number of the bits of the color data, using the second polarity gamma voltages, and outputs a second polarity data voltage corresponding to the grayscale of the input color data. The multiplexing part includes a plurality of multiplexers MX1, MX2, MX3, . . . , MXm. Each of the multiplexers MX1, MX2, MX3, . . . , MXm receives output signals of the first and second decoders D11, D21, D31, . . . , Dm1 and D12, D22, D32, . . . , Dm2, and outputs the first and second polarity data voltages in response to a polarity control signal POL provided from the timing controller 210.

Although not shown in FIG. 3, an output buffer connected to the digital-analog convertor 257 may be included. The output buffer compensates a level of a data voltage, which is an analog signal outputted form the digital-analog convertor 257.

In an exemplary embodiment, the multiplexers MX1, MX2, MX3, . . . , MXm receives the polarity control signal POL corresponding to a predetermined inversion method or a reversed polarity control signal POL. Here, 'm' is a natural number.

In an exemplary embodiment, the first and fourth multiplexers MX1 and MX4 receive the polarity control signal POL, and the second and third multiplexers MX2 and MX3 receive the reversed polarity control signal POL according to the positive (+), negative (−), negative (−) and positive (+) inversion method. When the polarity control signal POL is at a high level, each of the first and fourth multiplexers MX1 and MX4 selects an output signal of the first decoder D11, D21, D31, . . . , Dm1 of the first and second decoders D11, D21, D31, . . . , Dm1 and D12, D22, D32, . . . , Dm2, and outputs the selected output signal, and each of the second and third multiplexers MX2 and MX3 selects an output signal of the second decoder D12, D22, D32, . . . , Dm2 of the first and second decoders D11, D21, D31, . . . , Dm1 and D12, D22, D32, . . . , Dm2, and outputs the selected output signal. Thus, first and fourth output terminals OT1 and OT4 electrically connected to the first and fourth multiplexers MX1 and MX4 output the first polarity data voltages, and the second and third output terminals OT2 and OT3 electrically connected to the second and third multiplexers MX2 and MX3 output the second polarity data voltages.

The data driver 250 uses the column inversion method in which a polarity of the data voltage is reversed in every horizontal period 1H. In an exemplary embodiment, when the polarity control signal POL is at a high level during a first horizontal period, the polarity control signal POL is at a low level during a second horizontal period, according to the column inversion method. Thus, as described above, the first and fourth output terminals OT1 and OT4, which are electrically connected to the first and fourth multiplexers MX1 and MX4, respectively, output the first polarity data voltages in response to the polarity control signal POL at the high level during the first horizontal period, and the second and third output terminals OT2 and OT3, which are electrically connected to the second and third multiplexers MX2 and MX3, respectively, output the second polarity data voltages in response to the polarity control signal POL at the high level during the first horizontal period. In an alternative exemplary embodiment, the first and fourth output terminals OT1 and OT4, which are electrically connected to the first and fourth multiplexers MX1 and MX4, respectively, output the second polarity data voltages in response to the polarity control signal POL at the low level during the second horizontal period, and the second and third output terminals OT2 and OT3, which are electrically connected to the second and third multiplexers MX2 and MX3, respectively, output the first polarity data voltages in response to the polarity control signal POL at the low level during the second horizontal period.

Figure 4:
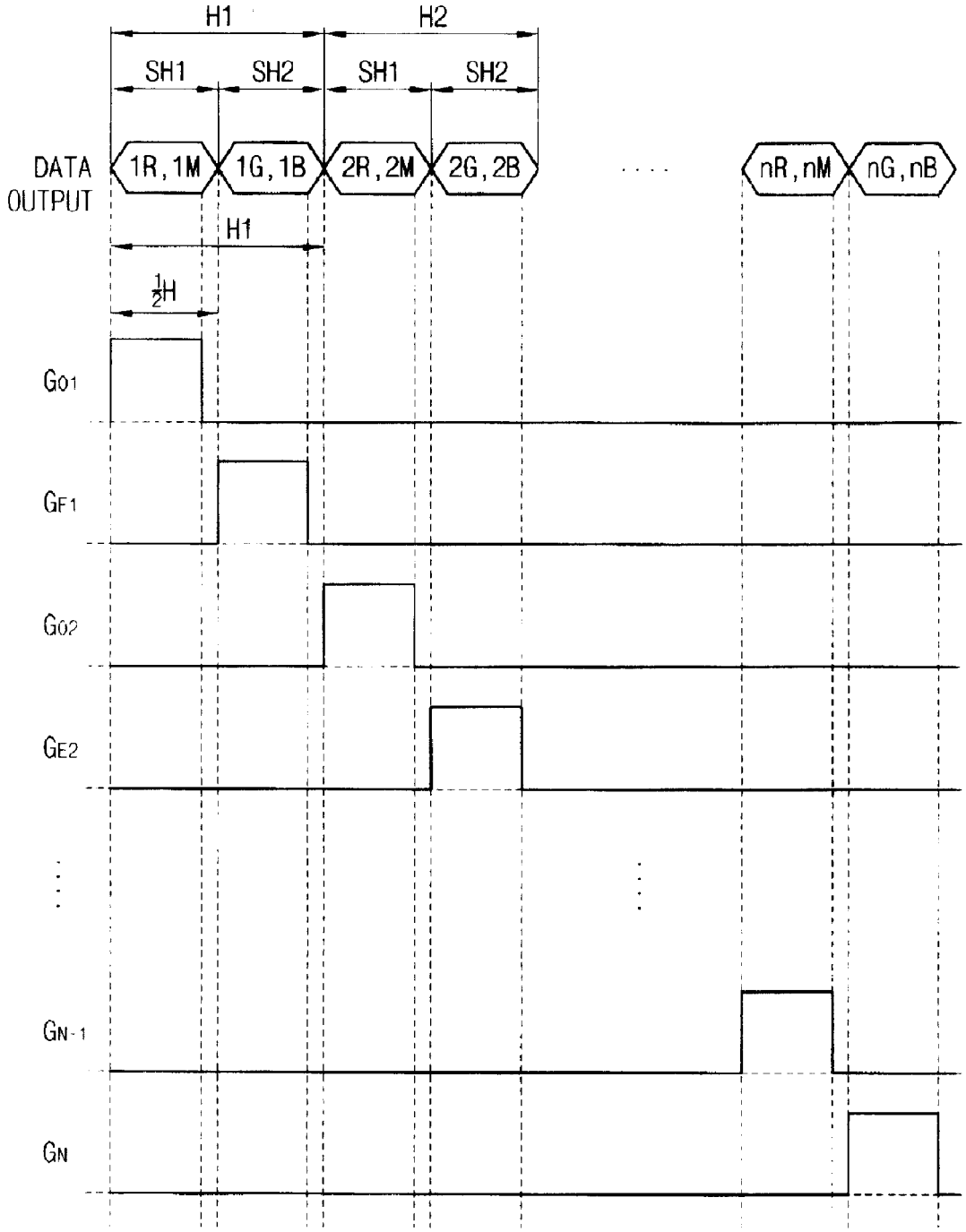
FIG. 4 is a signal timing diagram showing signals used in an exemplary embodiment of a method for driving the display panel in FIG. 1.

FIG. 4 is a signal timing diagram of signals used in an exemplary embodiment of a method driving for the display panel in FIG. 1.

Referring to FIGS. 1 and 4, the first gate driver 170 generates a plurality of odd-numbered gate signals $G_{O1}$, $G_{O2}$, . . . , $G_{N-1}$ and sequentially outputs the odd-numbered gate signals $G_{O1}$, $G_{O2}$, . . . , $G_{N-1}$ to odd-numbered gate lines of the gate lines GL1 to GLN that are disposed on the display panel 100.

The second gate driver 190 generates a plurality of even-numbered gate signals $G_{E1}$, $G_{E2}$, . . . , $G_N$ and sequentially outputs the even-numbered gate signals $G_{E1}$, $G_{E2}$, . . . , $G_N$ to even-numbered gate lines of the gate lines GL1 to GLN that are disposed on the display panel 100.

Each of the odd-numbered gate signals $G_{O1}$, $G_{O2}$, . . . , $G_{N-1}$ and the even-numbered gate signals $G_{E1}$, $G_{E2}$, . . . , $G_N$ has a pulse width corresponding to a half of one horizontal period ½H. A first gate signal $G_{O1}$ of the odd-numbered gate signals $G_{O1}$, $G_{O2}$, . . . , $G_{N-1}$ is applied to the first gate line GL1, and a first gate signal $G_{E1}$ of the even-numbered gate signals $G_{E1}$, $G_{E2}$, . . . , $G_N$ is applied to the second gate line GL2. The first and second gate lines GL1 and GL2 are activated during one horizontal period 1H by the first gate signals $G_{O1}$ and $G_{E1}$. Thus, pixels of the first subpixel row PL1 connected to the first and second gate lines GL1 and GL2 are activated during the one horizontal period 1H to display an image.

Hereinafter, a method for driving the display panel 100 is described in detail referring to FIGS. 1 to 4.

The data driver 250 outputs red and multi-primary data voltages 1R and 1M respectively corresponding to the red and multi-primary subpixels of the color subpixels in the first subpixel row PL1 during the first sub-period SH1 of the first horizontal period H1. The red and multi-primary subpixels are connected to the first gate line GL1. In an exemplary embodiment, the data driver 250 outputs the first polarity data voltage (+) corresponding to the first red subpixel Rp1 to the first data line DL1, outputs the second polarity data voltage (−) corresponding to the first multi-primary subpixel Mp1 to the second data line DL2, outputs the second polarity data voltage (−) corresponding to the second red subpixel Rp2 to the third data line DL3, and outputs the first polarity data voltage (+) corresponding to the second multi-primary subpixel Mp2 to the fourth data line DL4.

In addition, the first gate driver 170 outputs the first gate signal $G_{O1}$ having a high level to the first gate line GL1 during the first sub-period SH1 of the first horizontal period H1.

Therefore, the first polarity data voltage (+) is applied to the first red subpixel Rp1, the second polarity data voltage (−) is applied to the first multi-primary subpixel Mp1, the second polarity data voltage (−) is applied to the second red subpixel Rp2, and the first polarity data voltage (+) is applied to the second multi-primary subpixel Mp2.

The data driver 250 outputs green and blue data voltages 1G and 1B respectively corresponding to the green and blue subpixels of the color subpixels in the first subpixel row PL1 during the second sub-period SH2 of the first horizontal period H1. The green and blue subpixels are connected to the second gate line GL2. In an exemplary embodiment, the data driver 250 outputs the first polarity data voltage (+) corresponding to the first blue subpixel Bp1 to the first data line DL1, outputs the second polarity data voltage (−) corresponding to the first green subpixel Gp1 to the second data line DL2, outputs the second polarity data voltage (−) corresponding to the second blue subpixel Bp2 to the third data line DL3, and outputs the first polarity data voltage (+) corresponding to the second green subpixel Gp2 to the fourth data line DL4.

In addition, the second gate driver 190 outputs the first gate signal $G_{E1}$ having a high level to the second gate line GL2 during the second sub-period SH2 of the first horizontal period H1.

Therefore, the first polarity data voltage (+) is applied to the first blue subpixel Bp1, the second polarity data voltage (−) is applied to the green subpixel Gp1, the second polarity data voltage (−) is applied to the second blue subpixel Bp2, and the first polarity data voltage (+) is applied to the second green subpixel Gp2.

Then, the data driver 250 drives the color subpixels in the second subpixel row PL2 by the column inversion method. The data driver 250 outputs red and multi-primary data voltages 2R and 2M respectively corresponding to the red and multi-primary subpixels of the color subpixels in the second subpixel row PL2 during the first sub-period SH1 of the second horizontal period H2. The red and multi-primary subpixels are connected to the third gate line GL3. In an exemplary embodiment, the data driver 250 outputs the second polarity data voltage (−) corresponding to the third red subpixel Rp3 to the first data line DL1, outputs the first polarity data voltage (+) corresponding to the third multi-primary subpixel Mp3 to the second data line DL2, outputs the first polarity data voltage (+) corresponding to the fourth red subpixel Rp4 to the third data line DL3, and outputs the second polarity data voltage (−) corresponding to the fourth multi-primary subpixel Mp4 to the fourth data line DL4.

In addition, the first gate driver 170 outputs the second gate signal $G_{O2}$ having a high level to the third gate line GL3 during the first sub-period SH1 of the second horizontal period H2.

Therefore, the second polarity data voltage (−) is applied to the third red subpixel Rp3, the first polarity data voltage (+) is applied to the third multi-primary subpixel Mp3, the first polarity data voltage (+) is applied to the fourth red subpixel Rp4, and the second polarity data voltage (−) is applied to the fourth multi-primary subpixel Mp4.

The data driver 250 outputs green and blue data voltages 2G and 2B respectively corresponding to the green and blue subpixels of the color subpixels in the second subpixel row PL2 during the second sub-period SH2 of the second horizontal period H2. The green and blue subpixels are connected to the fourth gate line GL4. In an exemplary embodiment, the data driver 250 outputs the second polarity data voltage (−) corresponding to the third blue subpixel Bp3 to the first data line DL1, outputs the first polarity data voltage (+) corresponding to the third green subpixel Gp3 to the second data line DL2, outputs the first polarity data voltage (+) corresponding to the fourth blue subpixel Bp4 to the third data line DL3, and outputs the second polarity data voltage (−) corresponding to the fourth green subpixel Gp4 to the fourth data line DL4.

In addition, the second gate driver 190 outputs the second gate signal $G_{E2}$ having at a high level to the fourth gate line GL4 during the second sub-period SH2 of the second horizontal period H2.

Therefore, the second polarity data voltage (−) is applied to the third blue subpixel Bp3, the first polarity data voltage (+) is applied to the third green subpixel Gp3, the first polarity data voltage (+) is applied to the fourth blue subpixel Bp4, and the second polarity data voltage (−) is applied to the fourth green subpixel Gp4.

According to the column inversion method, the color subpixels in the second subpixel row PL2 receives data voltages having the polarity reversed to the data voltages applied to the color subpixels in the first subpixel row PL1.

In an exemplary embodiment, the data driver 250 and the first and second gate drivers 170 and 190 apply the data voltages having polarity inversion sequence in which the color subpixels in third to N-th subpixel rows are reversed as positive, negative, positive, negative, negative, positive, negative, positive or negative, positive, negative, positive, positive, negative, positive, negative, by the column inversion method.

Accordingly, the display panel 100 includes the red, green, blue and multi-primary subpixels, and the color subpixels are driven by the column inversion method having the polarity inversion sequence in which the color subpixels are reversed as positive, negative, positive, negative, negative, positive, negative, positive or negative, positive, negative, positive, positive, negative, positive, negative, such that data voltages having different polarities may be applied to the color subpixels adjacent to each other and the same color subpixels adjacent to each other. Thus, display quality is substantially enhanced.

Figure 5:
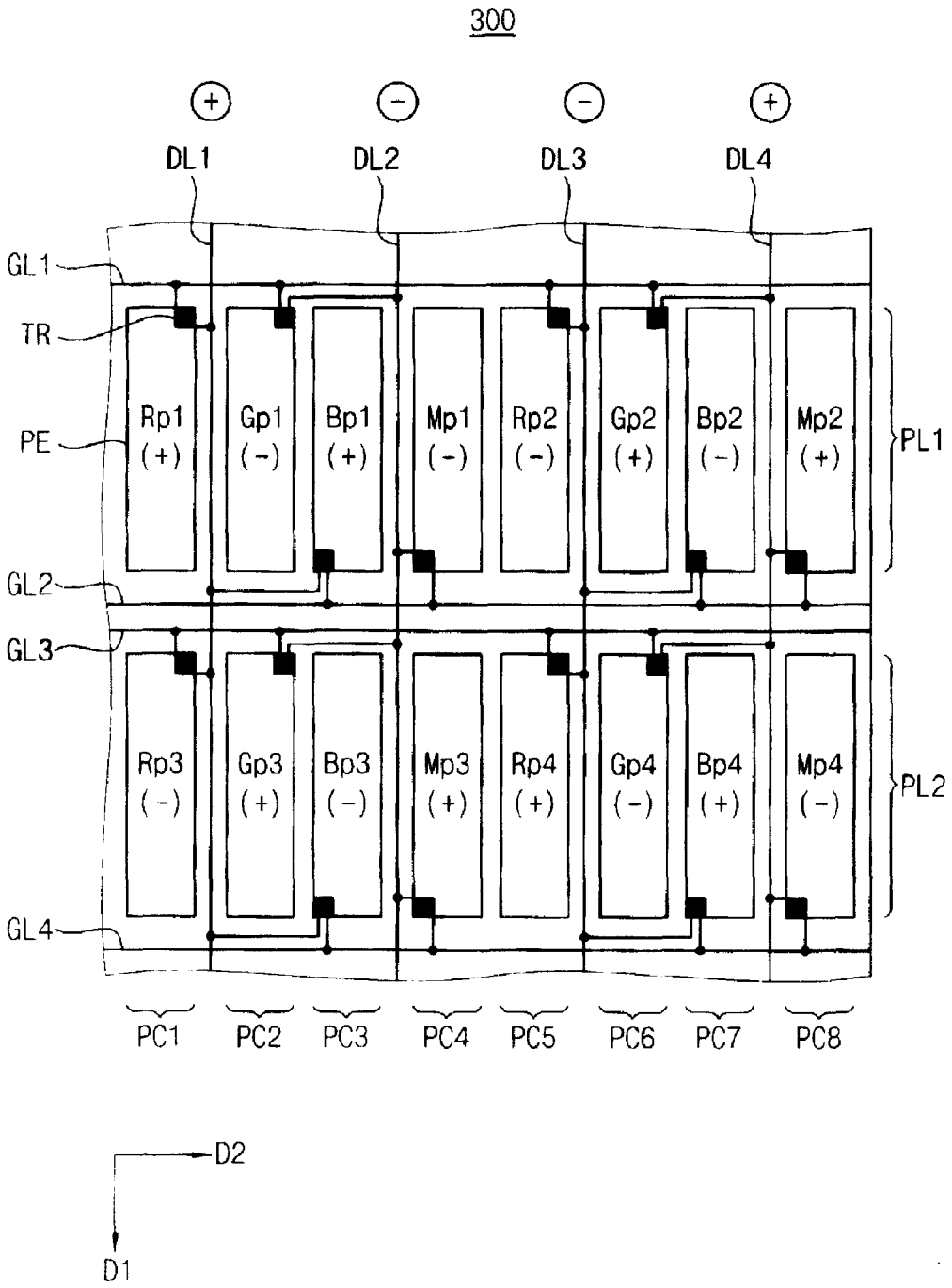
FIG. 5 is a top plan view of an alternative exemplary embodiment of the display panel according to the present invention.

FIG. 5 is a top plan view of an alternative exemplary embodiment of the display panel according to the present invention.

Referring to FIG. 5, the display panel 300 includes the plurality of data lines DL1, DL2, DL3 and DL4, the plurality of gate lines GL1, GL2, GL3, GL4, GL5 and GL6, and the plurality of color subpixels Rp1, Gp1, Bp1, Mp1, Rp2, Gp2, Bp2, Mp2, Rp3, Gp3, Bp3, Mp3, Rp4, Gp4, Bp4 and Mp4. The color subpixels are arranged in a matrix form having the plurality of subpixel rows PL1 and PL2 and the plurality of subpixel columns PC1, PC2, PC3, . . . , PC8. Each of the color subpixels includes the switching element TR and the pixel electrode PE. The switching element TR is electrically connected to a corresponding data line DL of the data lines, a corresponding gate line GL of the gate lines and the pixel electrode PE.

The first data line DL1 is disposed between the first and second subpixel columns PC1 and PC2. The second data line DL2 is disposed between the third and fourth subpixel columns PC3 and PC4. The third data line DL3 is disposed between the fifth and sixth subpixel columns PC5 and PC6. The fourth data line DL4 is disposed between the seventh and eighth subpixel columns PC7 and PC8. The first and second gate lines GL1 and GL2 are disposed above and below the first subpixel row PL1, respectively. The third and fourth gate lines GL3 and GL4 are disposed above and below the second subpixel row PL2, respectively.

The first red subpixel Rp1, the first green subpixel Gp1, the first blue subpixel Bp1, the first multi-primary subpixel Mp1, the second red subpixel Rp2, the second green subpixel Gp2, the second blue subpixel Bp2 and the second multi-primary subpixel Mp2 are disposed in the first subpixel row PL1.

The first red subpixel Rp1 is connected to the first gate line GL1 and the first data line DL1 through the switching element TR thereof. The first green subpixel Gp1 is connected to the first gate line GL1 and the second data line DL2 through the switching element TR thereof. The first blue subpixel Bp1 is connected to the second gate line GL2 and the first data line DL1 through the switching element TR thereof. The first multi-primary subpixel Mp1 is connected to the second gate line GL2 and the second data line DL2 through the switching element TR thereof.

The second red subpixel Rp2 is connected to the first gate line GL1 and the third data line DL3 through the switching element TR thereof. The second green subpixel Gp2 is connected to the first gate line GL1 and the fourth data line DL4 through the switching element TR of. The second blue subpixel Bp2 is connected to the second gate line GL2 and the third data line DL3 through the switching element TR thereof. The second multi-primary subpixel Mp2 is connected to the second gate line GL2 and the fourth data line DL4 through the switching element TR of.

The third red subpixel Rp3, the third green subpixel Gp3, the third blue subpixel Bp3, the third multi-primary subpixel Mp3, the fourth red subpixel Rp4, the fourth green subpixel Gp4, the fourth blue subpixel Bp4 and the fourth multi-primary subpixel Mp4 are disposed in the second subpixel row PL2.

The third red subpixel Rp3 is connected to the third gate line GL3 and the first data line DL1 through the switching element TR thereof. The third green subpixel Gp3 is connected to the third gate line GL3 and the second data line DL2 through the switching element TR thereof. The third blue subpixel Bp3 is connected to the fourth gate line GL4 and the first data line DL1 through the switching element TR thereof. The third multi-primary subpixel Mp3 is connected to the fourth gate line GL4 and the second data line DL2 through the switching element TR thereof.

The fourth red subpixel Rp4 is connected to the third gate line GL3 and the third data line DL3 through the switching element TR thereof. The fourth green subpixel Gp4 is connected to the third gate line GL3 and the fourth data line DL4 through the switching element TR thereof. The fourth blue subpixel Bp4 is connected to the fourth gate line GL4 and the third data line DL3 through the switching element TR thereof. The fourth multi-primary subpixel Mp4 is connected to the fourth gate line GL4 and the fourth data line DL4 through the switching element TR thereof.

Figure 6:
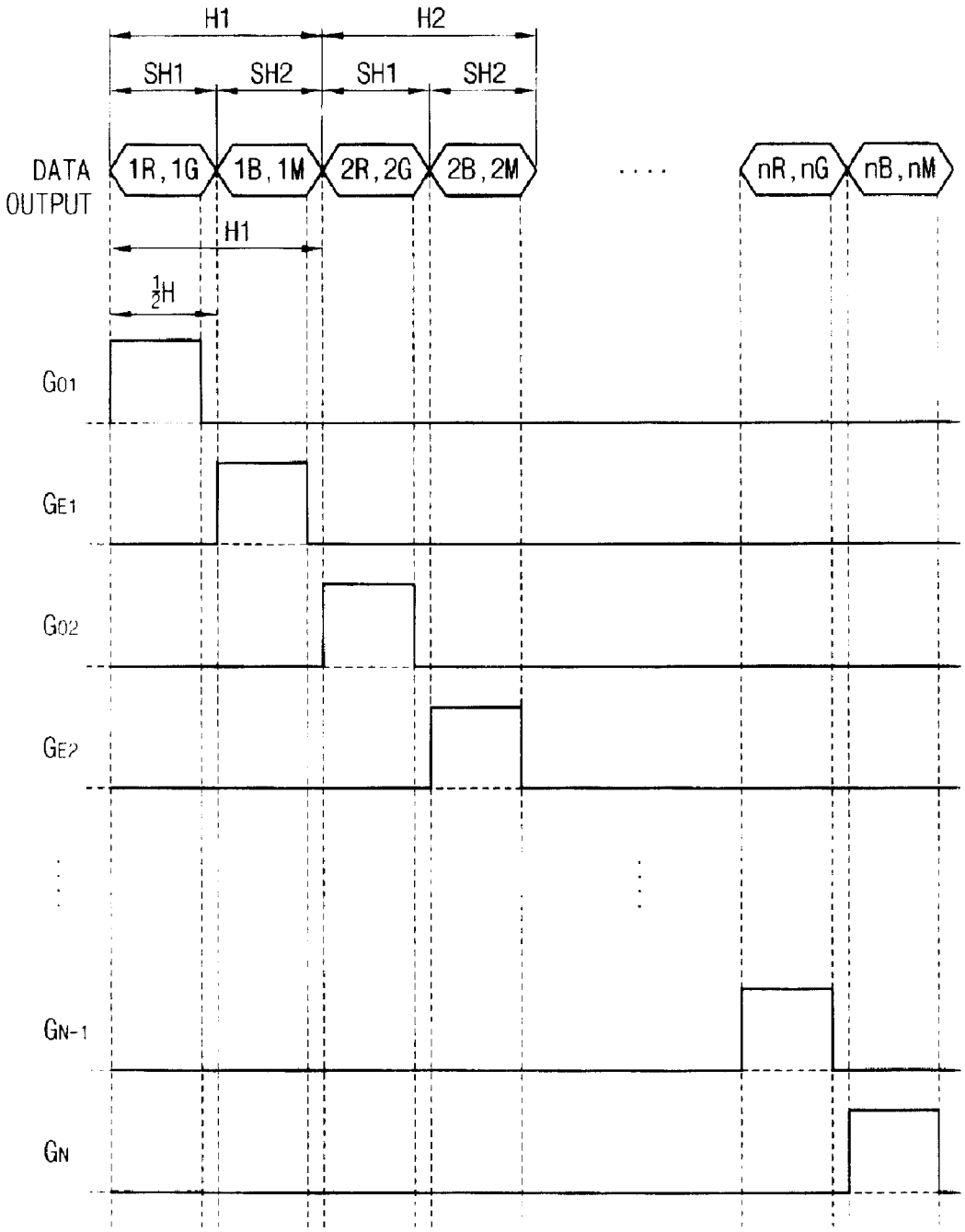
FIG. 6 is a signal timing diagram showing signals in an exemplary embodiment of the method for driving the display panel in FIG. 5.

FIG. 6 is a signal timing diagram of signals used in an alternative exemplary embodiment of the method for driving the display panel of FIG. 5. The same or like elements shown in FIGS. 5 and 6 have been labeled with the same reference characters as used to above to describe the exemplary embodiment shown in FIGS. 1 to 4, and any repetitive detailed description thereof will hereinafter be omitted or simplified.

Referring to FIGS. 1, 3, 5 and 6, the data arranger 240 rearranges the red, green, blue and multi-primary data received from the data converter 230 based on a color subpixel structure of the display panel 300.

The data arranger 240 rearranges color data of the first subpixel row PL1 to color data of the first red subpixel Rp1, the first green subpixel Gp1, the second red subpixel Rp2 and the second green subpixel Gp2, and outputs the color data of the first red subpixel Rp1, the first green subpixel Gp1, the second red subpixel Rp2 and the second green subpixel Gp2 during the first sub-period of the first horizontal period. In addition, the data arranger 240 rearranges the color data of the first subpixel row PL1 to color data of the first blue subpixel Bp1, the first multi-primary subpixel Mp1, the second blue subpixel Bp2 and the second multi-primary subpixel Mp2, and outputs the color data of the first blue subpixel Bp1, the first multi-primary subpixel Mp1, the second blue subpixel Bp2 and the second multi-primary subpixel Mp2 during the second sub-period of the first horizontal period. Then, the data arranger 240 rearranges color data of the second subpixel row PL2 to color data of the third red subpixel Rp3, the third green subpixel Gp3, the fourth red subpixel Rp4 and the fourth green subpixel Gp4, and outputs the color data of the third red subpixel Rp3, the third green subpixel Gp3, the fourth red subpixel Rp4 and the fourth green subpixel Gp4 during the first sub-period of the second horizontal period. In addition, the data arranger 240 rearranges the color data of the second subpixel row PL2 to color data of the blue subpixel Bp3, the third multi-primary subpixel Mp3, the fourth blue subpixel Bp4 and the fourth multi-primary subpixel Mp4, and outputs the color data of the blue subpixel Bp3, the third multi-primary subpixel Mp3, the fourth blue subpixel Bp4 and the fourth multi-primary subpixel Mp4 during a second sub-period of a second horizontal period. Each of the first and second sub-periods may correspond to a half of one horizontal period ½H.

The data driver 250 outputs red and green data voltages 1R and 1G respectively corresponding to the red and green subpixels of the color subpixels included in the first subpixel row PL1 during the first sub-period SH1 of the first horizontal period H1. The red and green subpixels are connected to the first gate line GL1. In an exemplary embodiment, the data driver 250 outputs the first polarity data voltage (+) corresponding to the first red subpixel Rp1 to the first data line DL1, outputs the second polarity data voltage (−) corresponding to the first green subpixel Gp1 to the second data line DL2, outputs the second polarity data voltage (−) corresponding to the second red subpixel Rp2 to the third data line DL3, and outputs the first polarity data voltage (+) corresponding to the second green subpixel Gp2 to the fourth data line DL4.

In addition, the first gate driver 170 outputs the first gate signal $G_{O1}$ having a high level to the first gate line GL1 during the first sub-period SH1 of the first horizontal period H1.

Therefore, the first polarity data voltage (+) is applied to the first red subpixel Rp1, the second polarity data voltage (−) is applied to the first green subpixel Gp1, the second polarity data voltage (−) is applied to the second red subpixel Rp2, and the first polarity data voltage (+) is applied to the second green subpixel Gp2.

Then, the data driver 250 outputs blue and multi-primary data voltages 1B and 1M respectively corresponding to the blue and multi-primary subpixels of the color subpixels in the first subpixel row PL1 during the second sub-period SH2 of the first horizontal period H1. The blue and multi-primary subpixels are connected to the second gate line GL2. In an exemplary embodiment, the data driver 250 outputs the first polarity data voltage (+) corresponding to the first blue subpixel Bp1 to the first data line DL1, outputs the second polarity data voltage (−) corresponding to the first multi-primary subpixel Mp1 to the second data line DL2, outputs the second polarity data voltage (−) corresponding to the second blue subpixel Bp2 to the third data line DL3, and outputs the first polarity data voltage (+) corresponding to the second multi-primary subpixel Mp2 to the fourth data line DL4.

In addition, the second gate driver 190 outputs the first gate signal $G_{E1}$ having a high level to the second gate line GL2 during the second sub-period SH2 of the first horizontal period H1.

Therefore, the first polarity data voltage (+) is applied to the first blue subpixel Bp1, the second polarity data voltage (−) is applied to the multi-primary subpixel Mp1, the second polarity data voltage (−) is applied to the second blue subpixel Bp2, and the first polarity data voltage (+) is applied to the second multi-primary subpixel Mp2.

Then, the data driver 250 drives the color subpixels included in the second subpixel row PL2 by the column inversion method. The data driver 250 outputs red and green data voltages 2R and 2G respectively corresponding to the red and green subpixels of the color subpixels included in the second subpixel row PL2 during the first sub-period SH1 of the second horizontal period H2. The red and green subpixels are connected to the third gate line GL3. In an exemplary embodiment, the data driver 250 outputs the second polarity data voltage (−) corresponding to the third red subpixel Rp3 to the first data line DL1, outputs the first polarity data voltage (+) corresponding to the third green subpixel Gp3 to the second data line DL2, outputs the first polarity data voltage (+) corresponding to the fourth red subpixel Rp4 to the third data line DL3, and outputs the second polarity data voltage (−) corresponding to the fourth green subpixel Gp4 to the fourth data line DL4.

In addition, the first gate driver 170 outputs the second gate signal $G_{O2}$ having a high level to the third gate line GL3 during the first sub-period SH1 of the second horizontal period H2.

Therefore, the second polarity data voltage (−) is applied to the third red subpixel Rp3, the first polarity data voltage (+) is applied to the third green subpixel Gp3, the first polarity data voltage (+) is applied to the fourth red subpixel Rp4, and the second polarity data voltage (−) is applied to the fourth green subpixel Gp4.

Then, the data driver 250 outputs blue and multi-primary data voltages 2B and 2M respectively corresponding to the blue and multi-primary subpixels of the color subpixels included in the second subpixel row PL2 during the second sub-period SH2 of the second horizontal period H2. The blue and multi-primary subpixels are connected to the fourth gate line GL4. In an exemplary embodiment, the data driver 250 outputs the second polarity data voltage (−) corresponding to the third blue subpixel Bp3 to the first data line DL1, outputs the first polarity data voltage (+) corresponding to the third multi-primary subpixel Mp3 to the second data line DL2, outputs the first polarity data voltage (+) corresponding to the fourth blue subpixel Bp4 to the third data line DL3, and outputs the second polarity data voltage (−) corresponding to the fourth multi-primary subpixel Mp4 to the fourth data line DL4.

In addition, the second gate driver 190 outputs the second gate signal $G_{E2}$ having a high level to the fourth gate line GL4 during the second sub-period SH2 of the second horizontal period H2.

Therefore, the second polarity data voltage (−) is applied to the third blue subpixel Bp3, the first polarity data voltage (+) is applied to the third multi-primary subpixel Mp3, the first polarity data voltage (+) is applied to the fourth blue subpixel Bp4, and the second polarity data voltage (−) is applied to the fourth multi-primary subpixel Mp4.

According to the column inversion method, the color subpixels in the second subpixel row PL2 receives data voltages having the polarity opposite to the data voltages applied to the color subpixels in the first subpixel row PL1.

In an exemplary embodiment, the data driver 250 and the first and second gate drivers 170 and 190 apply data voltages having the polarity inversion sequence in which the color subpixels in the third to N-th subpixel rows are reversed as positive, negative, positive, negative, negative, positive, negative, positive or negative, positive, negative, positive, positive, negative, positive, negative, by the column inversion method.

Accordingly, the display panel 300 includes red, green, blue and multi-primary subpixels, and the color subpixels are driven by the column inversion method having the polarity inversion sequence in which the color subpixels are reversed as positive, negative, positive, negative, negative, positive, negative, positive or negative, positive, negative, positive, positive, negative, positive, negative, such that data voltages having different polarities may be applied to the color subpixels adjacent to each other and the same color subpixels adjacent to each other. Thus, display quality is substantially enhanced.

Figure 7:
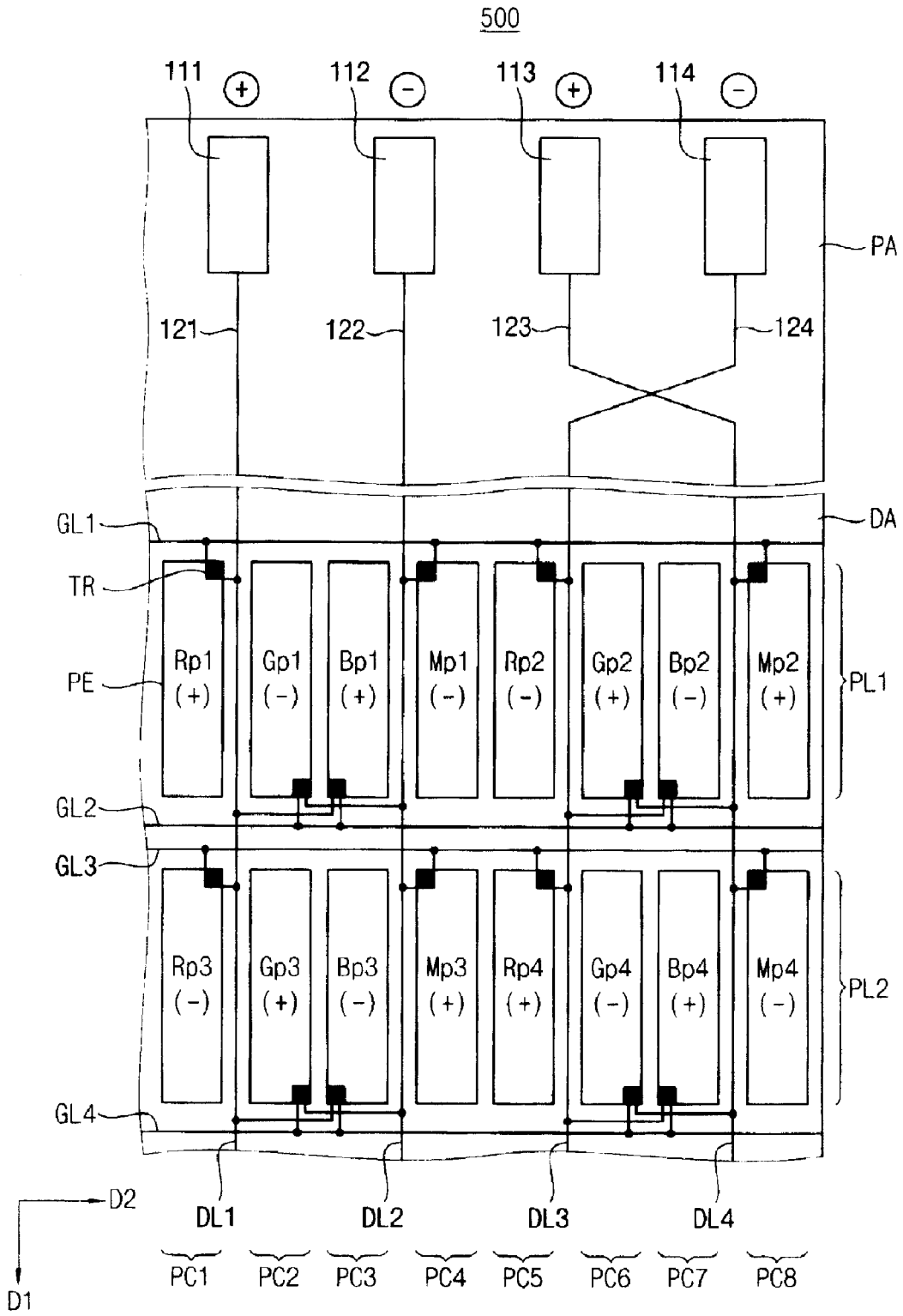
FIG. 7 is a top plan view of another alternative exemplary embodiment of the display panel according to the present invention.

FIG. 7 is a top plan view of another alternative exemplary embodiment of the display panel according to the present invention.

Referring to FIG. 7, a display panel 500 includes a display area DA and a peripheral area PA surrounding at least a portion of the display area DA.

The display area DA includes a plurality of color subpixels. In an exemplary embodiment, the display area DA includes the plurality of data lines DL1, DL2, DL3 and DL4, the plurality of gate lines GL1, GL2, GL3, GL4, GL5 and GL6, and the plurality of color subpixels Rp1, Gp1, Bp1, Mp1 Rp2, Gp2, Bp2, Mp2, Rp3, Gp3, Bp3, Mp3, Rp4, Gp4, Bp4 and Mp4. The color subpixels are arranged in a matrix form having the plurality of subpixel rows PL1 and PL2, and the plurality of subpixel columns PC1, PC2, PC3, . . . , PC8. Each of the color subpixels includes the switching element TR and the pixel electrode PE. The switching element TR is electrically connected to the corresponding data line DL, the corresponding gate line GL and the pixel electrode PE.

The first data line DL1 is disposed between the first and second subpixel columns PC1 and PC2. The second data line DL2 is disposed between the third and fourth subpixel columns PC3 and PC4. The third data line DL3 is disposed between the fifth and sixth subpixel columns PC5 and PC6. The fourth data line DL4 is disposed between the seventh and eighth subpixel columns PC7 and PC8. The first and second gate lines GL1 and GL2 are respectively disposed above and below the first subpixel row PL1. The third and fourth gate lines GL3 and GL4 are respectively disposed above and below the second subpixel row PL2.

The first red subpixel Rp1, the first green subpixel Gp1, the first blue subpixel Bp1, the first multi-primary subpixel Mp1, the second red subpixel Rp2, the second green subpixel Gp2, the second blue subpixel Bp2 and the second multi-primary subpixel Mp2 are disposed in the first subpixel row PL1. The third red subpixel Rp3, the third green subpixel Gp3, the third blue subpixel Bp3, the third multi-primary subpixel Mp3, the fourth red subpixel Rp4, the fourth green subpixel Gp4, the fourth blue subpixel Bp4 and the fourth multi-primary subpixel Mp4 are disposed in the second subpixel row PL2.

The display panel in FIG. 7 is substantially the same as the display panel shown in FIG. 2 except for pads and connection lines. The same or like elements shown in FIG. 7 have been labeled with the same reference characters as used above to describe the exemplary embodiments of the display panel shown in FIG. 2, and any repetitive detailed description thereof will hereinafter be omitted or simplified.

The peripheral area PA includes a plurality of pads, e.g. a first pad 111, as second pad 112, a third pad 113 and a fourth pad 114, and a plurality of connection lines, e.g., a first connection line 121, a second connection line 122, a third connection line 123 and a fourth connection line 124.

Each of the pads 111, 112, 113 and 114 is connected to an output terminal of a data driver, and receives a data voltage from the data driver.

The connection lines 121, 122, 123 and 124 connect the pads 111, 112, 113 and 114 with the data lines DL1, DL2, DL3 and DL4. In an exemplary embodiment, the first connection line 121 connects the first pad 111 with the first data line DL1. The second connection line 122 connects the second pad 112 with the second data line DL2. The third connection line 123 connects the third pad 113 with the fourth data line DL4. The fourth connection line 124 connects the fourth pad 114 with the third data line DL3. In an exemplary embodiment, the third and fourth connection lines 123 and 124 cross each other, and each of the third and fourth connection lines 123 and 124 is disposed in different conductive layers which are insulated by an insulating layer.

Accordingly, a data voltage received from the first pad 111 is transferred to the first data line DL1 through the first connection line 121. A data voltage received from the second pad 112 is transferred to the second data line DL2 through the second connection line 122. A data voltage received from the third pad 113 is transferred to the fourth data line DL4 through the third connection line 123. A data voltage received from the fourth pad 114 is transferred to the third data line DL3 through the fourth connection line 124.

Figure 8:
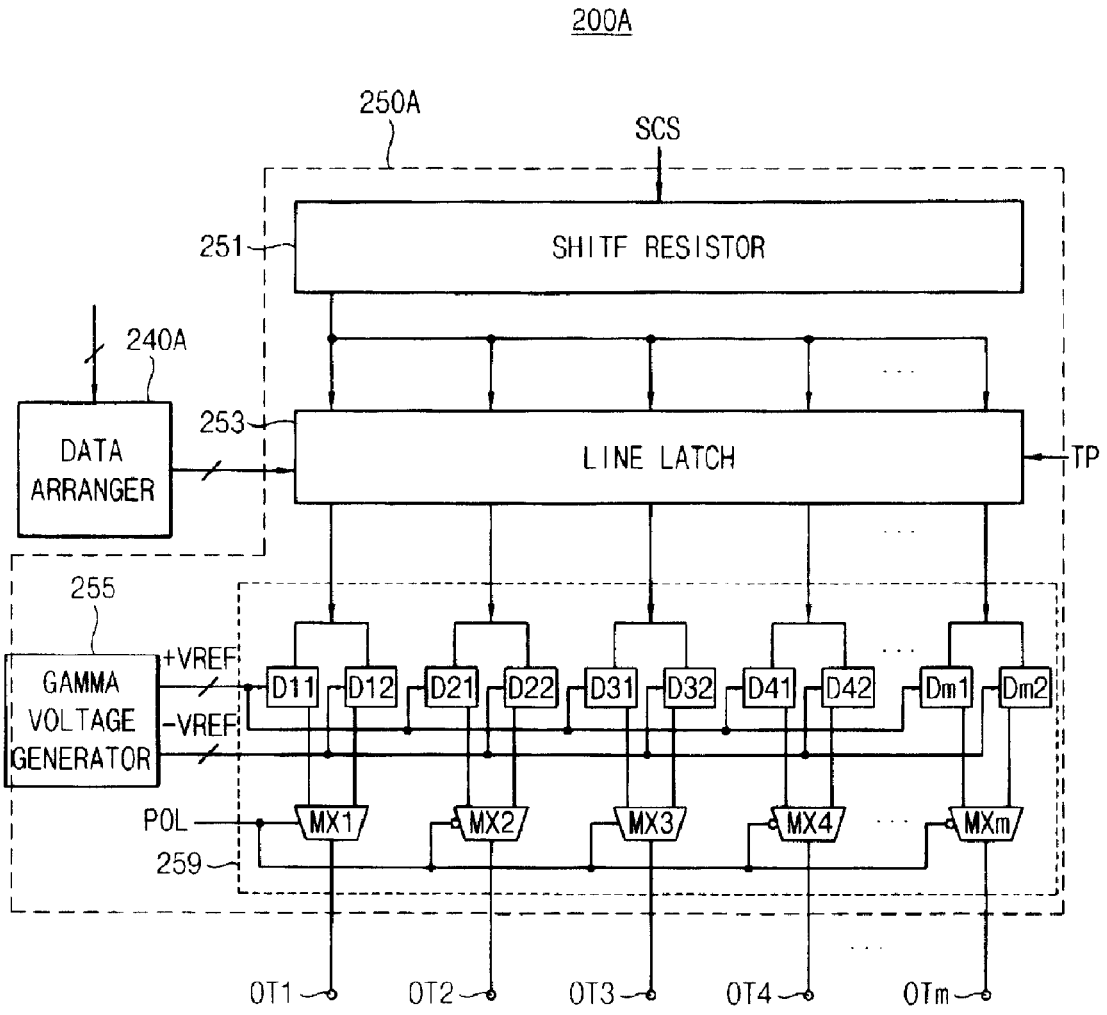
FIG. 8 is a block diagram illustrating an exemplary embodiment of a panel driver which drives the display panel in FIG. 7.

FIG. 8 is a block diagram illustrating an exemplary embodiment of the panel driver which drives the display panel of FIG. 7.

Referring to FIGS. 1, 7 and 8, the panel driver 200A includes a data arranger 240A and a data driver 250A. The panel driver 200A in FIG. 8 is substantially the same as the panel driver 200 shown in FIGS. 1 to 4 except for the data arranger 240A and the data driver 250A. The same or like elements shown in FIG. 8 have been labeled with the same reference characters as used above to describe the exemplary embodiments of the panel driver shown in FIGS. 1 to 4, and, any repetitive detailed description thereof will hereinafter be omitted or simplified.

The data arranger 240A rearranges the red, green, blue and multi-primary data received from the data converter 230 based on a connection structure between the data lines DL1, DL2, DL3 and DL4 and the pads 111, 112, 113 and 114 of the display panel 500 in FIG. 7.

In an exemplary embodiment, the first pad 111 is connected to the first data line DL1, the second pad 112 is connected to the second data line DL2, the third pad 113 is connected to the fourth data line DL4, and the fourth pad 114 is connected to the third data line DL.

The data arranger 240A rearranges color data of the first subpixel row PL1 to color data of the first red subpixel Rp1, the first multi-primary subpixel Mp1, the second multi-primary subpixel Mp2 and the second red subpixel Rp2, and outputs the color data of the first red subpixel Rp1, the first multi-primary subpixel Mp1, the second multi-primary subpixel Mp2 and the second red subpixel Rp2 during a first sub-period of a first horizontal period. In addition, the data arranger 240 rearranges the color data of the first subpixel row PL1 to color data of the first blue subpixel Bp1, the first green subpixel Gp1, the second green subpixel Gp2 and the second blue subpixel Bp2, and outputs the color data of the first blue subpixel Bp1, the first green subpixel Gp1, the second green subpixel Gp2 and the second blue subpixel Bp2 during a second sub-period of a first horizontal period. Then, the data arranger 240 rearranges color data of the second subpixel row PL2 to color data of the third red subpixel Rp3, the third multi-primary subpixel Mp3, the fourth multi-primary subpixel Mp4 and the fourth red subpixel Rp4, and outputs the color data of the third red subpixel Rp3, the third multi-primary subpixel Mp3, the fourth multi-primary subpixel Mp4 and the fourth red subpixel Rp4 during a first sub-period of a second horizontal period. In addition, the data arranger 240 rearranges the color data of the second subpixel row PL2 to color data of the third blue subpixel Bp3, the third green subpixel Gp3, the fourth green subpixel Gp4 and the fourth blue subpixel Bp4, and outputs color data of the third blue subpixel Bp3, the third green subpixel Gp3, the fourth green subpixel Gp4 and the fourth blue subpixel Bp4 during a second sub-period of a second horizontal period. Each of the first and second sub-periods may correspond to a half of one horizontal period ½H.

The data driver 250A includes a shift resistor 251, a line latch 253, a gamma voltage generator 255 and a digital-analog convertor 259. The shift resistor 251, the line latch 253 and the gamma voltage generator 255 in FIG. 8 are substantially same as the shift resistor 251, the line latch 253 and the gamma voltage generator 255 of data driver 250 shown in FIGS. 1 to 4. Thus, any repetitive detailed description thereof will hereinafter be omitted or simplified.

The digital-analog convertor 259 includes a first decoding part, a second decoding part and multiplexing part. The first decoding part includes a plurality of first decoders D11, D21, D31, . . . , Dm1. Each of the first decoders D11, D21, D31, . . . , Dm1 outputs first polarity data voltages based on a grayscale of inputted color data using first polarity gamma voltages. The second decoding part includes a plurality of second decoders D12, D22, D32, . . . , Dm2. Each of the second decoders D12, D22, D32, . . . , Dm2 outputs second polarity data voltages based on a grayscale of inputted color data using second polarity gamma voltages. The multiplexing part includes a plurality of multiplexers MX1, MX2, MX3, . . . , MXm. Each of the multiplexers MX1, MX2, MX3, . . . , MXm receives output signals of the first and second decoders D11, D21, D31, . . . , Dm1 and D12, D22, D32, . . . , Dm2, and outputs the first or second polarity data voltages in response to a polarity control signal POL provided from the timing controller 210.

Although not shown in FIG. 8, an output buffer connected to the digital-analog convertor 259 may be included. The output buffer compensates a level of data voltage which is an analog signal outputted from the digital-analog convertor 259.

In an exemplary embodiment, the odd-numbered multiplexers MX1, MX3 . . . receive the polarity control signal POL as it is. The even-numbered multiplexers MX2, MX4 . . . receive the polarity control signal POL by reversing a polarity of the polarity control signal POL. When the polarity control signal POL is at a high level, the multiplexers MX1, MX2, MX3, . . . , MXm output the first polarity data voltages. When the polarity control signal POL is at a low level, the multiplexers MX1, MX2, MX3, . . . , MXm output the second polarity data voltages.

Accordingly, a polarity of the data voltages outputted from odd-numbered output terminals OT1, OT3 . . . and a polarity of the data voltages outputted from even-numbered output terminals OT2, OT4 . . . are opposite to each other. In an exemplary embodiment, the data driver 250A outputs data voltages corresponding to an inversion method of positive, negative, positive, negative during the first horizontal period, and outputs data voltages corresponding to an inversion method of negative, positive, negative, positive during the second horizontal period.

Accordingly, a first output terminal OT1 of the data driver 250A outputs the first polarity data voltage (+), a second output terminal OT2 of the data driver 250A outputs the second polarity data voltage (−), a third output terminal OT3 of the data driver 250A outputs the first polarity data voltage (+), and a fourth output terminal OT4 of the data driver 250A outputs the second polarity data voltage (−).

Thus, the first and third pads 111 and 113 of the display panel 500 receive the first polarity data voltage (+), and the second and fourth pads 112 and 114 of the display panel 500 receive the second polarity data voltage (−).

The first polarity data voltage (+) is applied to the first data line DL1 connected to the first pad 111, such that the first red subpixel Rp1 and the first blue subpixel Bp1 connected to the first data line DL1 receive the first polarity data voltage (+). The second polarity data voltage (−) is applied to the second data line DL2 connected to the second pad 112, such that the first green subpixel Gp1 and the first multi-primary subpixel Mp1 connected to the second data line DL2 receive the second polarity data voltage (−). The first polarity data voltage (+) is applied to the fourth data line DL4 connected to the third pad 113, such that the second green subpixel Gp2 and the second multi-primary subpixel Mp2 connected to the fourth data line DL4 receive the first polarity data voltage (+). The second polarity data voltage (−) is applied to the third data line DL4 connected to the fourth pad 114, such that the second red subpixel Rp2 and the second blue subpixel BP2 connected to the third data line DL3 receive the second polarity data voltage (−).

Waveforms of output signals of data and gate drivers which drive the display panel 500 in FIG. 8 are substantially the same as the waveforms of output signals shown in FIG. 4.

Accordingly, the display panel 500 includes red, green, blue and multi-primary subpixels, and the color subpixels are driven by the column inversion method having polarity inversion sequence in which the color subpixels are reversed as positive, negative, positive, negative, negative, positive, negative, positive or negative, positive, negative, positive, positive, negative, positive, negative, such that data voltages having different polarities may be applied to the color subpixels adjacent to each other in a same pixel and to same color subpixels adjacent to each other. Thus, display quality is substantially enhanced.

Figure 9:
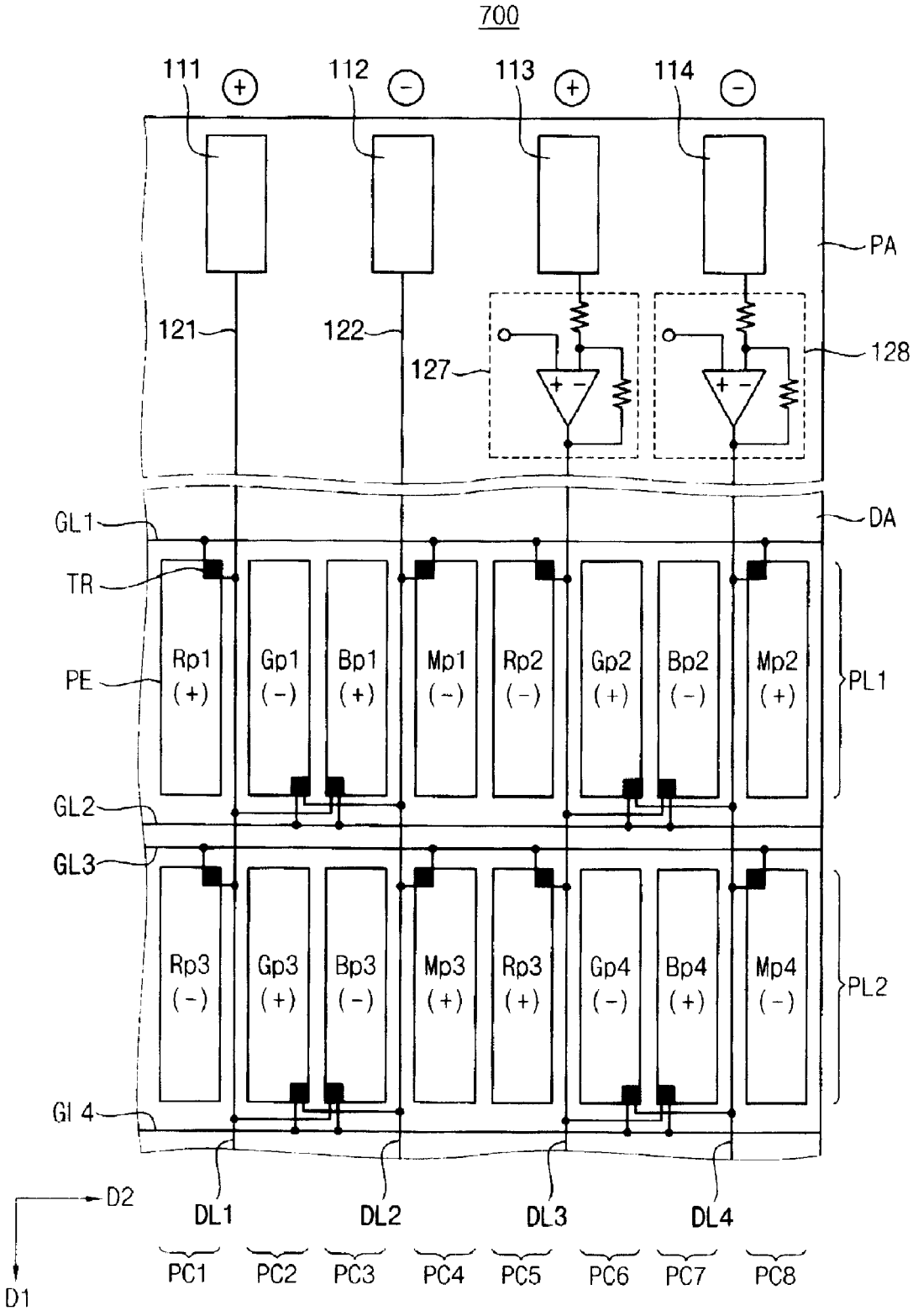
FIG. 9 is a top plan view of still another alternative exemplary embodiment of the display panel according to the present invention.

FIG. 9 is a top plan view of another alternative exemplary embodiment of the display panel according to the present invention.

Referring to FIGS. 1 and 9, the display panel 700 includes a display area DA and a peripheral area PA surrounding at least a portion of the display area DA.

The display area DA includes the plurality of color subpixels. In an exemplary embodiment, the display area DA includes the plurality of data lines DL1, DL2, DL3 and DL4, the plurality of gate lines GL1, GL2, GL3, GL4, GL5 and GL6, and the plurality of color subpixels Rp1, Gp1, Bp1, Mp1, Rp2, Gp2, Bp2, Mp2, Rp3, Gp3, Bp3, Mp3, Rp4, Gp4, Bp4 and Mp4. The color subpixels are arranged in a matrix form having the plurality of subpixel rows PL1 and PL2 and the plurality of subpixel columns PC1, PC2, PC3, . . . , PC8. Each of the color subpixels includes the switching element TR and the pixel electrode PE. The switching element TR is electrically connected to the data lines DL, the gate lines GL and the pixel electrode PE. A structure of the color subpixel of the display panel 700 in FIG. 9 is substantially the same as the structure of the color subpixel shown in FIG. 2. Thus, any repetitive detailed description thereof will hereinafter be omitted or simplified. Similarly, the structure of the color subpixel in FIG. 9 is substantially the same as the structure of the color subpixel shown in FIG. 5.

The peripheral area PA includes a plurality of pads, e.g., the first pad 111, the second pad 112, the third pad 113 and the fourth pad 114, a plurality of connection lines, e.g., the first connection line 121 and the second connection line 122, and a plurality of reverse elements, e.g., a first reverse element 127 and a second reverse element 128.

The pads 111, 112, 113 and 114 are connected to output terminals of a data driver, and receive data voltages from the data driver.

The connection lines 121 and connect the first and second pads 111 and 112 with the first and second data lines DL1 and DL2, respectively. In an exemplary embodiment, the first connection line 121 connects the first pad 111 with the first data line DL1, and the second connection line 122 connects the second pad 112 with the second data line DL2.

The plurality of reverse elements 127 and 128 connect the third and fourth pads 113 and 114 with the third and fourth data lines DL3 and DL4, respectively. In an exemplary embodiment, the first reverse element 127 connects the third pad 113 with the third data line DL3, and the second reverse element 128 connects the fourth pad 114 with the fourth data line DL4. The reverse elements 127 and 128 reverse polarities of data voltages received from the third and fourth pads 113 and 114 with respect to a reference voltage, respectively, and output the reversed data voltages. In an exemplary embodiment, the reverse elements 127 and 128 may be directly formed on the peripheral area PA during a process of forming the switching element TR on the display area DA.

Accordingly, a voltage received from the first pad 111 is transferred to the first data line DL1 through the first connection line 121, and a voltage received from the second pad 112 is transferred to the second data line DL1 through the second connection line 122. A voltage received from the third pad 113 is reversed by the first reverse element 127, and the reversed voltage is applied to the third data line DL3. A voltage received from the fourth pad 114 is reversed by the second reverse element 128, and the reversed voltage is applied to the fourth data line DL4.

The display panel 700 in FIG. 9 may be driven by the data arranger 240 of FIG. 1 and the data driver 200A of FIG. 8.

In an exemplary embodiment, the data arranger 240 rearranges color data of the first subpixel row PL1 to color data of the first red subpixel Rp1, the first multi-primary subpixel Mp1, the second red subpixel Rp2 and the second multi-primary subpixel Mp2, and outputs the color data of the first red subpixel Rp1, the first multi-primary subpixel Mp1, the second red subpixel Rp2 and the second multi-primary subpixel Mp2 during a first sub-period of a first horizontal period. In addition, the data arranger 240 rearranges the color data of the first subpixel row PL1 to color data of the first blue subpixel Bp1, the first green subpixel Gp1, the second blue subpixel Bp2 and the second green subpixel Gp2, and outputs the color data of the first blue subpixel Bp1, the first green subpixel Gp1, the second blue subpixel Bp2 and the second green subpixel Gp2 during a second sub-period of a first horizontal period. Then, the data arranger 240 rearranges color data of the second subpixel row PL2 to color data of the third red subpixel Rp3, the third multi-primary subpixel Mp3, the fourth red subpixel Rp4 and the fourth multi-primary subpixel Mp4, and outputs the color data of the third red subpixel Rp3, the third multi-primary subpixel Mp3, the fourth red subpixel Rp4 and the fourth multi-primary subpixel Mp4 during a first sub-period of a second horizontal period. In addition, the data arranger 240 rearranges the color data of the second subpixel row PL2 to color data of the third blue subpixel Bp3, the third green subpixel Gp3, the fourth blue subpixel Bp4 and the fourth green subpixel Gp4, and outputs the color data of the third blue subpixel Bp3, the third green subpixel Gp3, the fourth blue subpixel Bp4 and the fourth green subpixel Gp4 during a second sub-period of a second horizontal period. Each of the first and second sub-periods may correspond to a half of one horizontal period ½H.

The data driver 250A may include the shift resistor 251, the line latch 253, the gamma voltage generator 255 and the digital-analog convertor 259, similarly to the described referring to FIG. 8. Thus, any repetitive detailed description thereof will be omitted or simplified.

The data driver 250A outputs a first polarity data voltage (+) through the odd-numbered output terminals OT1, OT3 . . . , and outputs a second polarity data voltage (−) through the even-numbered output terminals OT2, OT4 . . . . Thus, the first and third pads 111 and 113 of the display panel 700 receive the first polarity data voltage (+), and the second and fourth pads 112 and 114 of the display panel 500 receive the second polarity data voltage (−).

The first polarity data voltage (+) is applied to the first data line DL1 connected to the first pad 111, such that the first red subpixel Rp1 and the first blue subpixel Bp1 connected to the first data line DL1 receive the first polarity data voltage (+). The second polarity data voltage (−) is applied to the second data line DL2 connected to the second pad 112, such that the first green subpixel Gp1 and the first multi-primary subpixel Mp1 connected to the second data line DL2 receive the second polarity data voltage (−).

In addition, the third pad 113 receives the first polarity data voltage (+) but applies the second polarity data voltage (−) to the third data line DL3 through the first reverse elements 127. Thus, the second red subpixel Rp2 and the second blue subpixel Bp2 connected to the third data line DL3 receive the second polarity data voltage (−). The fourth pad 114 receives the second polarity data voltage (−) but applies the first polarity data voltage (+) to the fourth data line DL4 through the second reverse elements 128. Thus, the second green subpixel Gp2 and the second multi-primary subpixel Mp2 connected to the fourth data line DL4 receive the first polarity data voltage (+).

Waveforms of output signals of data and gate drivers which drive the display panel 700 in FIG. 9 are substantially the same as the waveforms of the output signals shown in FIG. 4.

Accordingly, the display panel 700 includes red, green, blue and multi-primary subpixels, and the color subpixels are driven by the column inversion method having the polarity inversion sequence in which the color subpixels are reversed as positive, negative, positive, negative, negative, positive, negative, positive or negative, positive, negative, positive, positive, negative, positive, negative, such that data voltages having different polarities may be applied to the color subpixels adjacent to each other in a same pixel and same color subpixels adjacent to each other. Thus, display quality is substantially enhanced.

Although not shown in FIG. 9, a switching element may be formed between the pads and the data lines, such that data voltages having polarity sequence of positive, negative, positive, negative may be reversed to data voltages having polarity sequence of positive, negative, negative, positive.

Alternatively, an area of each of subpixels may be different from each other. In an exemplary embodiment, an area of a blue subpixel is greater than an area of each of green and yellow subpixels. An area of a red subpixel is greater than an area of each of green and yellow subpixels. The area of the blue subpixel is substantially the same as the area of the red subpixel. The area of the green subpixel is substantially the same as the area of the yellow subpixel. However, the areas of the subpixels described above are not limited thereto. In an alternative exemplary embodiment, the area of each of subpixels may be modified or changed to adjust a white balance.

In an exemplary embodiment, a data line may be shared by two colors of subpixels, and thus the number of the data lines may be reduced without increasing a manufacturing cost. In addition, data voltages having different polarities are applied to adjacent subpixels having a same color, and display quality is thereby substantially increased.

The foregoing is illustrative of the present invention and is not to be construed as limiting thereof. Although a limited number of exemplary embodiments of the present invention have been described, those skilled in the art will readily appreciate that various modifications in form and details may be made therein without materially departing from the spirit or scope of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific exemplary embodiments set forth herein, and that modifications to the disclosed exemplary embodiments are intended to be included within the scope of the appended claims. The present invention is defined by the following claims, with equivalents of the claims to be included therein.

What is claimed is:

1. A display panel comprising:

a plurality of pixels defining a display area, each pixel in the display area comprising at least four even-numbered subpixels in a same subpixel row, separate and independent from any subpixels in a contiguous pixel, wherein the at least four even-numbered subpixels comprise:

a first color subpixel including a pixel electrode electrically connected to a switching element which is connected to a first data line and a first gate line;

a second color subpixel including a pixel electrode electrically connected to a switching element which is connected to a second data line and a second gate line, wherein the second data line is disposed adjacent to the first data line;

a third color subpixel including a pixel electrode electrically connected to a switching element which is connected to the first data line and the second gate line; and a fourth color subpixel including a pixel electrode electrically connected to a switching element which is connected to the second data line and the first gate line, wherein the first to fourth color subpixels are configured to display different colors from each other, wherein the pixel electrode of the second color subpixel is connected to the second data line via a first data applying line extending directly from the second data line, wherein the pixel electrode of the third color subpixel is connected to the first data line via a second data applying line extending directly from the first data line, and wherein the first data applying line and the second data applying line intersect each other in a plan view, such that a positive polarity voltage and a negative polarity voltage are applied alternately in a row direction to the first to fourth color subpixels when the first data line receives a voltage having a polarity opposite to a voltage applied to the second data line.

2. The display panel of claim 1, wherein the first to third color subjects respectively display selected one of red, green and blue, and the fourth color subpixel displays one color of white, yellow, cyan and magenta.

3. The display panel of claim 1, further comprising:

a fifth color subpixel configured to display a same color as the first color subpixel and including a pixel electrode electrically connected to a switching element which is connected to a third data line and the first gate line, wherein the third data line is disposed adjacent to the second data line;

a sixth color subpixel configured to display a same color as the second color subpixel and including a pixel electrode electrically connected to a switching element which is connected to a fourth data line and the second gate line, wherein the fourth data line is disposed adjacent to the third data line;

a seventh color subpixel configured to display a same color as the third color subpixel and including a pixel electrode electrically connected to a switching element which is connected to the third data line and the second gate line; and an eighth color subpixel configured to display a same color as the fourth color subpixel and including a pixel electrode electrically connected to a switching element which is connected to the fourth data line and the first gate line.

4. The display panel of claim 3, further comprising:

a first pad;

a second pad disposed adjacent to the first pad;

a third pad disposed adjacent to the second pad;

a fourth pad disposed adjacent to the third pad;

a first connection line which connects the first pad with the first data line;

a second connection line which connects the second pad with the second data line;

a third connection line which connects the third pad with the fourth data line; and a fourth connection line which connects the fourth pad with the third data line.

5. The display panel of claim 3, further comprising:

a first pad;

a second pad disposed adjacent to the first pad;

a third pad disposed adjacent to the second pad;

a fourth pad disposed adjacent to the third pad;

a first connection line which connects the first pad with the first data line;

a second connection line which connects the second pad with the second data line;

a first reverse element which connects the third pad with the third data line and reverses a data voltage received from the third pad with respect to a reference voltage; and a second reverse element which connects the fourth pad with the fourth data line and reverses a data voltage received from the fourth pad with respect to the reference voltage.

6. The display panel of claim 1, further comprising:

a first gate driver connected to the first gate line, wherein the first gate driver applies a first gate signal to the first gate line; and a second gate driver connected to the second gate line, wherein the second gate driver applies a second gate signal to the second gate line.

7. The display panel of claim 6, wherein each of the first gate driver and the second gate driver includes a switching element comprising amorphous silicon.

8. The display panel of claim 7, wherein the first gate driver is disposed adjacent to a first side of a display area, in which the pixels are disposed, and the second gate driver is disposed adjacent to a second side of the display area, wherein the second side is opposite to the first side.

9. The display panel of claim 1, wherein the at least four even-numbered subpixels in a same subpixel row are four contiguous subpixels.

10. A display apparatus comprising:

a display panel comprising:

a plurality of pixels defining a display area, each pixel in the display area including at least four even-numbered subpixels in a same subpixel row, separate and independent from any subpixels in a contiguous pixel;

a first gate driver connected to a first gate line and disposed adjacent to a first side of a display area, in which the pixels are disposed; and a second gate driver connected to a second gate line and disposed adjacent to a second side of the display area, wherein the second side is different from the first side, wherein the at least four even-numbered subpixels comprise:

a first color subpixel including a pixel electrode electrically connected to a switching element which is connected to a first data line extending along a first direction and the first gate line extending along a second direction;

a second color subpixel including a pixel electrode electrically connected to a switching element which is connected to a second data line and the second gate line, the second data line being adjacent to the first data line;

a third color subpixel including a pixel electrode electrically connected to a switching element which is connected to the first data line and the second gate line; and a fourth color subpixel including a pixel electrode electrically connected to a switching element which is connected to the second data line and the first gate line; and a panel driver which drives the display panel, wherein the first to fourth color subpixels are configured to display different colors from each other, wherein the panel driver applies a first polarity voltage to each of the first color subpixel and the third color subpixel, and applies a second polarity voltage to each of the second color subpixel and the fourth color subpixel, wherein the second polarity voltage is reversed from the first polarity voltage with respect to a reference voltage, wherein the pixel electrode of the second color subpixel is connected to the second data line via a first data applying line extending directly from the second data line, wherein the pixel electrode of the third color subpixel is connected to the first data line via a second data applying line extending directly from the first data line; and wherein the first data applying line and the second data applying line intersect each other in a plan view such that a positive polarity voltage and a negative polarity voltage are applied alternately in a row direction to the first to fourth color subpixels when the first data line receives a voltage having a polarity opposite to a voltage applied to the second data line.

11. The display apparatus of claim 10, wherein the display panel further comprises:

a fifth color subpixel configured to display a same color as the first color subpixel and including a pixel electrode electrically connected to a switching element which is connected to a third data line and the first gate line, wherein the third data line is disposed adjacent to the second data line;

a sixth color subpixel configured to display a same color as the second color subpixel and including a pixel electrode electrically connected to a switching element which is connected to a fourth data line and the second gate line, wherein the fourth data line is adjacent to the third data line;

a seventh color subpixel configured to display a same color as the third color subpixel and including a pixel electrode electrically connected to a switching element which is connected to the third data line and the second gate line; and an eighth color subpixel configured to display a same color as the fourth color subpixel and including a pixel electrode electrically connected to a switching element which is connected to the fourth data line and the first gate line.

12. The display apparatus of claim 11, wherein the panel driver applies the first polarity voltage to the first data line, applies the second polarity voltage to the second data line, applies the second polarity voltage to the third data line, and applies the first polarity voltage to the fourth data line.

13. The display apparatus of claim 12, wherein the display panel further comprises:

a first pad;

a second pad disposed adjacent to the first pad;

a third pad disposed adjacent to the second pad;

a fourth pad disposed adjacent to the third pad;

a first connection line which connects the first pad with the first data line;

a second connection line which connects the second pad with the second data line;

a third connection line which connects the third pad with the fourth data line; and a fourth connection line which connects the fourth pad with the third data line, and wherein the panel driver applies the first polarity voltage to the first pad, applies the second polarity voltage to the second pad, applies the first polarity voltage to the third pad, and applies the second polarity voltage to the fourth pad.

14. The display apparatus of claim 12, wherein the display panel further comprises:

a first pad;

a second pad disposed adjacent to the first pad;

a third pad disposed adjacent to the second pad;

a fourth pad disposed adjacent to the third pad;

a first connection line which connects the first pad with the first data line;

a second connection line which connects the second pad with the second data line;

a first reverse element which connects the third pad with the third data line and reverses a data voltage received from the third pad with respect to a reference voltage; and a second reverse element which connects the fourth pad with the fourth data line and reversing a data voltage received from the fourth pad with respect to the reference voltage, wherein the panel driver applies the first polarity voltage to the first pad, applies the second polarity voltage to the second pad, applies the first polarity voltage to the third pad, and applies the second polarity voltage to the fourth pad.

15. The display apparatus of claim 10, wherein each of the first gate driver and the second gate driver includes a switching element comprising amorphous silicon.

16. The display apparatus of claim 15, wherein the first gate line and the second gate line are alternately arranged with each other along the first direction.

17. The display apparatus of claim 10, wherein the at least four even-numbered subpixels in a same subpixel row are four contiguous subpixels.

* * * * *